United States Patent [19]

Kirby, Jr.

[11] 4,023,485

[45] May 17, 1977

[54] PRINTING APPARATUS

[75] Inventor: Raymond L. Kirby, Jr., Vandalia, Ohio

[73] Assignee: Monarch Marking Systems, Inc., Dayton, Ohio

[22] Filed: July 5, 1973

[21] Appl. No.: 376,669

Related U.S. Application Data

[62] Division of Ser. No. 215,783, Jan. 6, 1972, Pat. No. 3,832,943.

[52] U.S. Cl. ..... 101/111; 101/105

[51] Int. Cl.[2] ..... B41J 1/20

[58] Field of Search ..... 101/111, 105, 90, 368, 101/374, 110

[56] References Cited

UNITED STATES PATENTS

| | | | |
|---|---|---|---|
| 743,455 | 11/1903 | Comstock | 101/111 |
| 1,075,822 | 10/1913 | Gregory | 101/110 |
| 1,143,445 | 6/1915 | Scotford | 101/111 |
| 1,205,315 | 11/1916 | Anthony et al. | 101/111 |
| 2,193,564 | 3/1940 | Melind | 101/111 |
| 3,338,160 | 8/1967 | Heil | 101/111 X |

*Primary Examiner*—Edward M. Coven
*Attorney, Agent, or Firm*—Joseph J. Grass

[57] ABSTRACT

There is disclosed a printing, feeding and severing method and apparatus for carrying out the method. The apparatus includes a print head assembly and a platen assembly movable relatively toward and away from each other into and out of printing cooperation, mechanism for inking the print head assembly, mechanism for feeding a web of record members to between the print head assembly and the platen assembly, the web being in roll form and there being means to assist the gradual unwinding of the roll with gradual paying out of web material from the roll to the feeding mechanism, an idler contacting the web and disposed at a slight angle to the direction of feed of the web to cause the web to follow a feed edge, record severing means disposed downstream of the print head assembly and the platen assembly, and a modular support assembly of a print head of the print head assembly.

10 Claims, 35 Drawing Figures

FIG-2
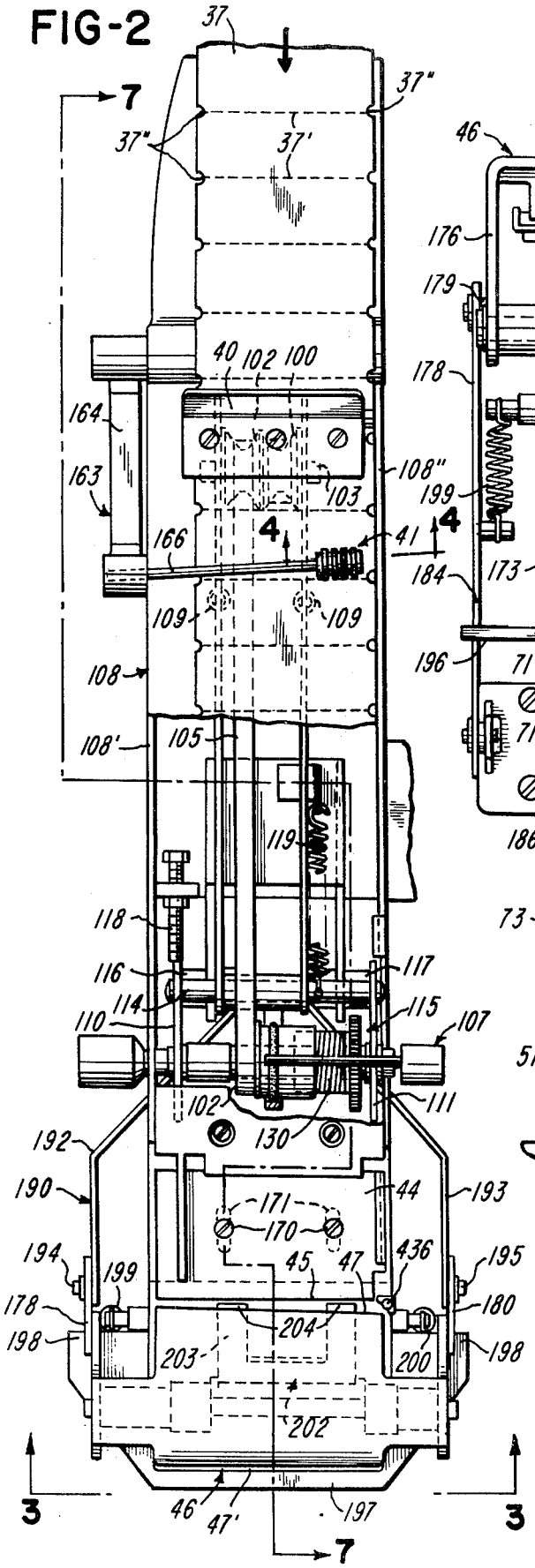
FIG-3
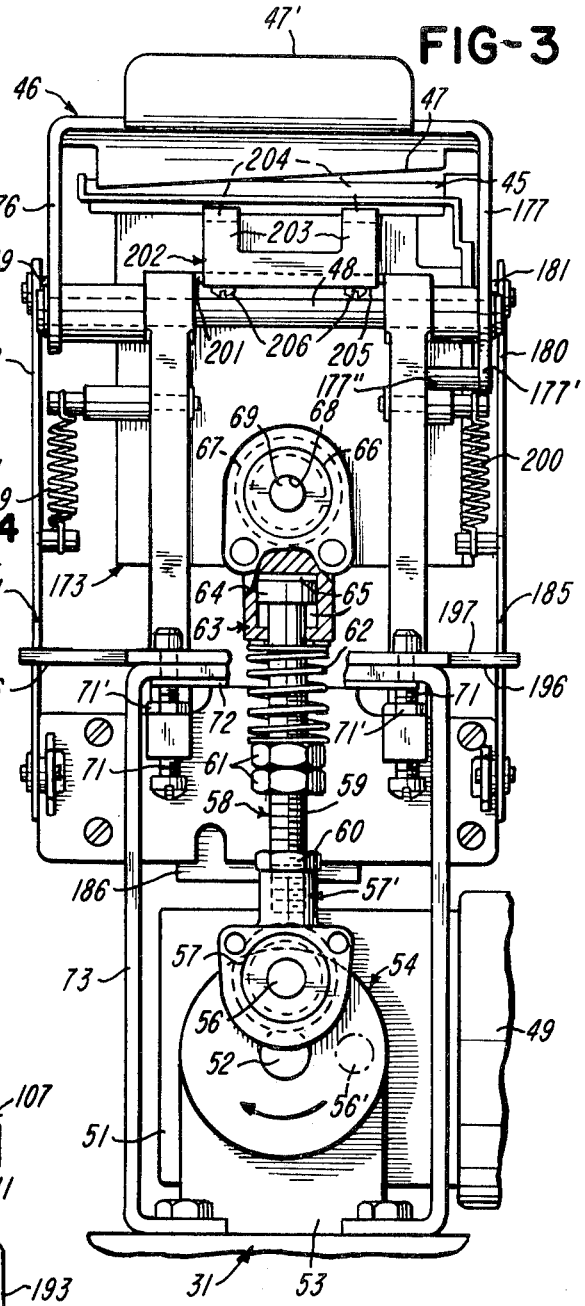
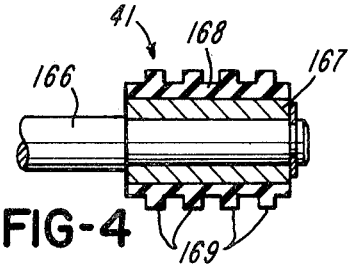
FIG-4

FIG-18
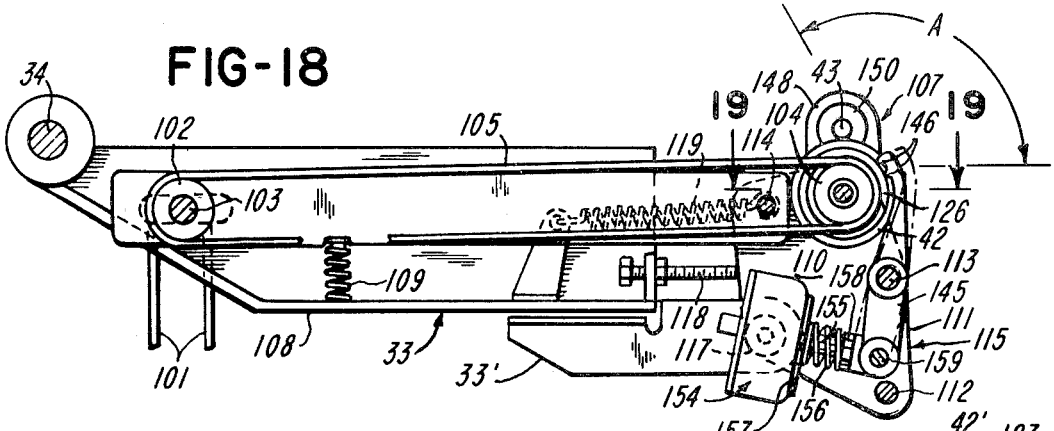
FIG-19
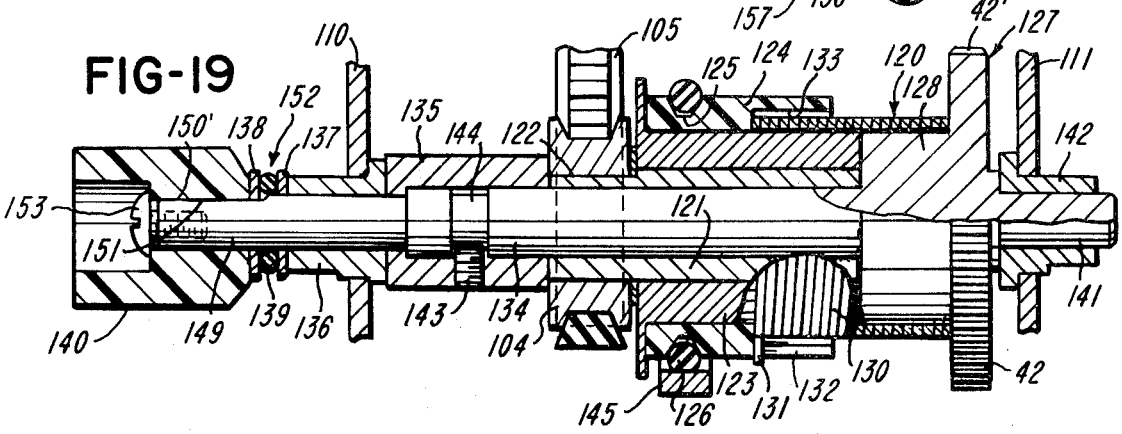
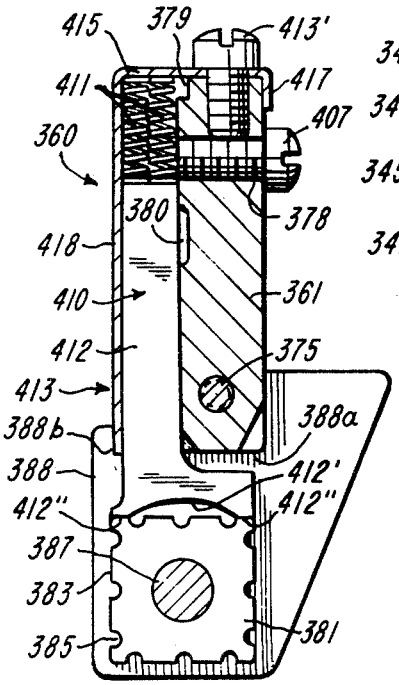
FIG-23
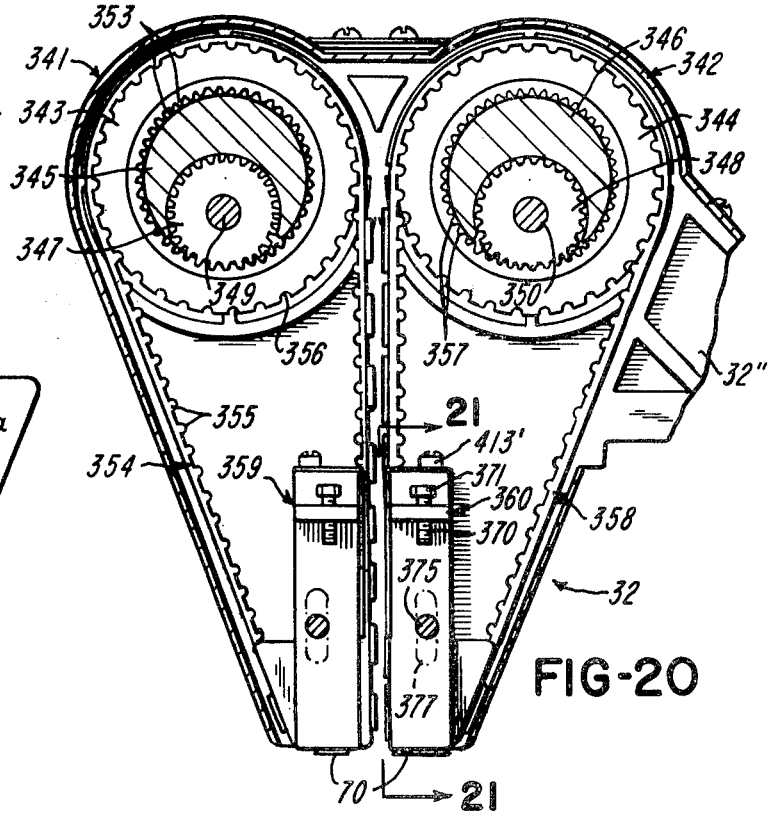
FIG-20

FIG-24
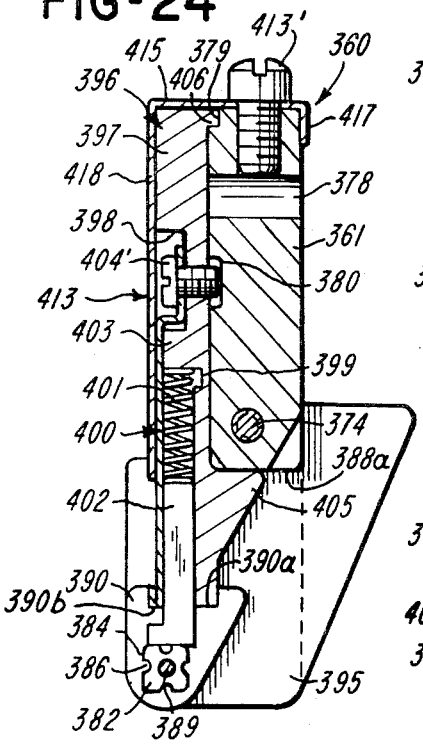
FIG-25
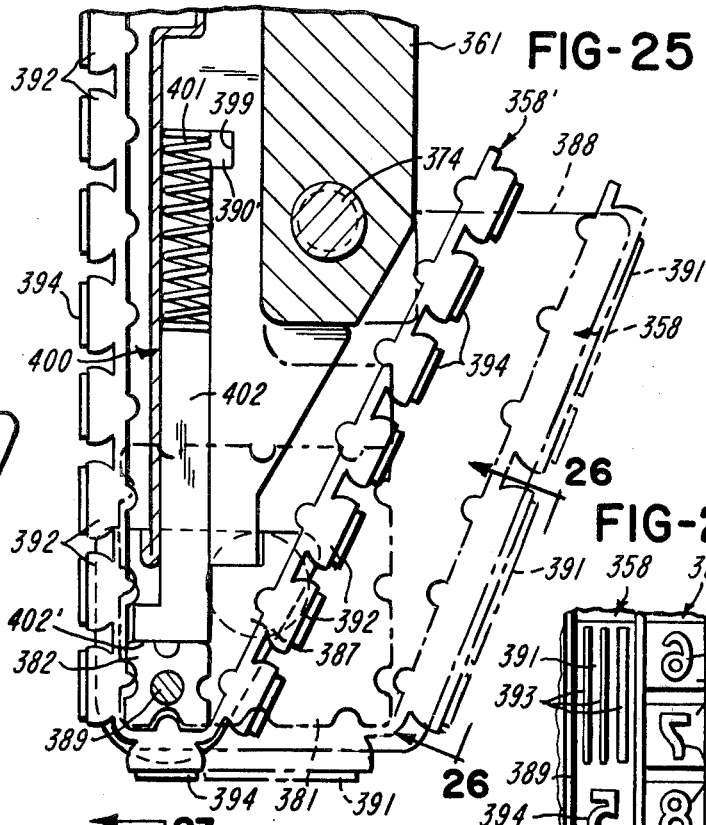
FIG-26
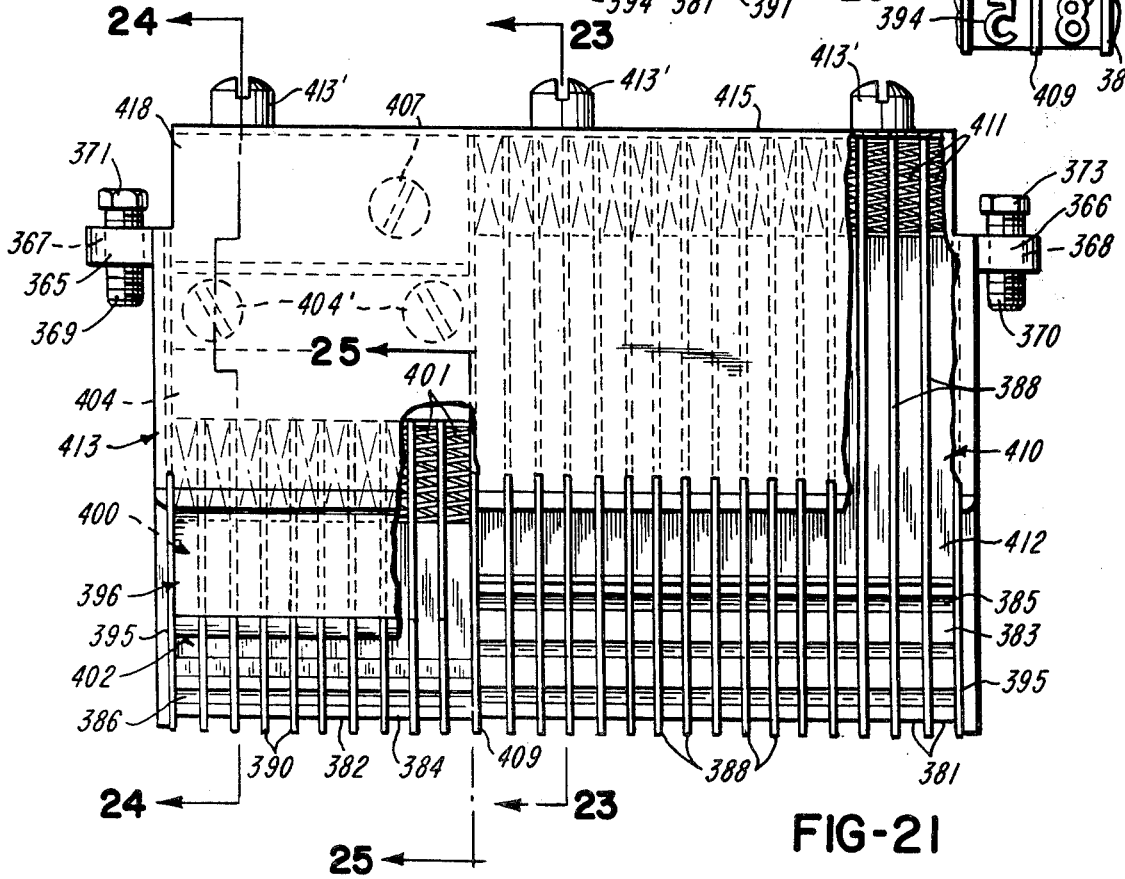
FIG-21

30A
32'
35A
31A
33
34
35
42
43
452
454
455
456
457
458
458'
459
460
461
462
464
466
468
470
471
472
473
474
475
476
477
478
479
480
481
482
483
484
485
486
488
489
490
491
492
254
258
262
211
213
251
251'

PRINTING APPARATUS

CROSS-REFERENCE TO RELATED APPLICATION

This is a division of application Ser. No. 215,783, filed Jan. 6, 1972, now U.S. Pat. No. 3,832,943.

SUMMARY OF THE INVENTION

The invention also comprises a modular support assembly for mounting the different sizes of printing bands using different size supports. It is preferred to use different size multisided wheels as the supports in a modular arrangement enabling a line of printing to be made up for example of: different size printing elements for printing both large and small characters; small elements for printing human readable characters and elongated bar-shaped elements for printing a machine readable code; and so on. The modular arrangement of the supports promotes this flexibility of choice using printing bands.

PRIOR ART

The following U.S. Pats. Nos. are made of record: 3,180,254 and 3,228,601.

BRIEF DESCRIPTION OF THE DRAWINGS

FIG. 2 is a top plan view generally along lines 2—2 of FIG. 1;

FIG. 3 is a partial front elevational view generally along line 3–3 of FIG. 2;

FIG. 4 is a sectional view taken along line 4–4 of FIG. 2;

FIG. 18 is an elevational view showing the feeding mechanism by which the record members are fed;

FIG. 19 is a sectional view taken along line 19–19 of FIG. 18;

FIG. 20 is an elevational view through the print head assembly showing the manner in which the printing bands are mounted; FIG. 21 is an elevational view taken generally along line 21—21 of FIG. 20, but omitting the printing bands;

FIG. 23 is a sectional view taken along line 23—23 of FIG. 21;

FIG. 24 is a sectional view taken along line 24—24 of FIG. 21;

FIG. 25 is an elevational sectional view taken along line 25—25 of FIG. 21;

FIG. 26 is a view taken generally along line 26—26 of FIG. 25;

DESCRIPTION OF THE PREFERRED EMBODIMENTS

Figure 1:
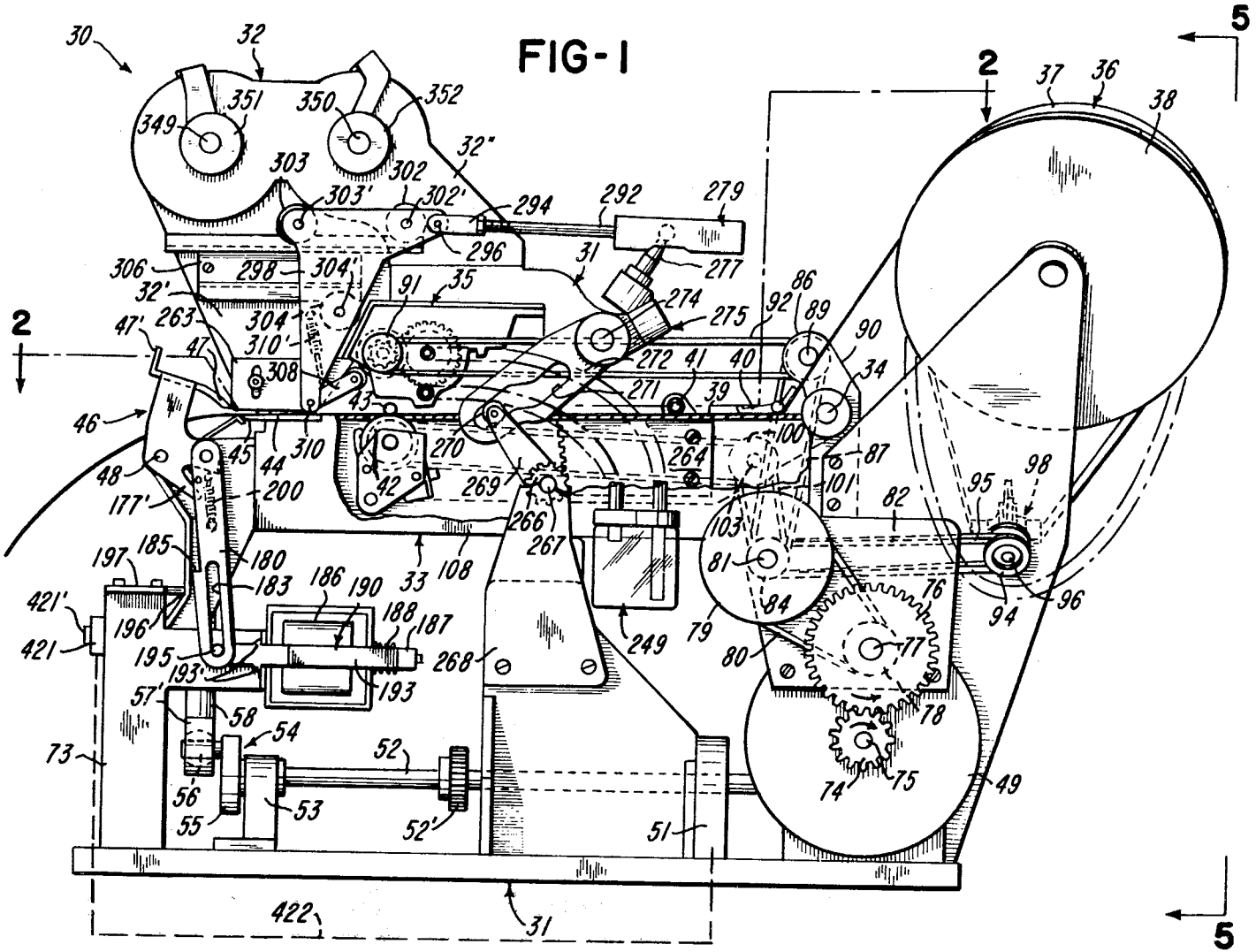
FIG. 1 is a side elevational view showing one side of printing apparatus in accordance with the invention.

Referring to FIG. 1, there is shown a printing apparatus generally indicated at 30 including a frame generally indicated at 31. A print head ssembly 32 is fixedly mounted to the frame 31 and a platen assembly generally indicated at 33 is pivotally mounted to the frame 31 by a pivot point 34. An inking mechanism or inker generally indicated at 35 is provided for inking the print head assembly 32. A roll 36 of record members 37 arranged in web form is mounted by a rotatable reel 38 mounted by the frame 31. The web of record members 37 passes under and partly around a rotary feed member 98, from there it passes into contact with, over and partly around the roll 36 of record members 37 and from there onto the upper surface 39 of the platen assembly 33 beneath a hold-down plate 40 and an aligning roll 41. From there the web of record members 37 passes between a feed wheel 42 and a roll 43. From there the web of record members 37 is advanced to a rigid platen 44 of the platen assembly 33. The feed wheel 42 operates near the end of each machine cycle to advance the printing record member or members 37 to a position in which the trailing edge of the advanced record member or members 37 are at a fixed knife 45 of a severing mechanism generally indicated at 46. The severing mechanism 46 which is downstream of the feed wheel 42 also includes a movable knife 47. The movable knife 47 is pivotally mounted about a pivot 48 and is cooperable with the fixed knife 45 to sever the previously printed record member or members 37 from the remainder of the web.

An electric motor 49 is mounted to the frame 31. The electric motor 49 drives a speed reducer 50 which in turn is connected to the input of a clutch indicated diagrammatically at 51. The clutch 51 is shown in greater detail at 153 in U.S. Pat No. 3,180,254. The output of the clutch 51 is connected to a drive shaft 52 journaled in a bearing 53. An eccentric generally indicated at 54 in the form of a crank 55 has an eccentrically mounted crank pin 56. The pin 56 is received by a ball 57 received in a socket 57'. The socket 57' forms part of a connecting rod generally indicated at 58.

With reference to FIG. 3, the connecting rod socket 57' is shown to threadably receive a rod 59. A lock nut 60 threadably received by the rod or rod section 59 maintains the adjusted position of the rod 59 relative to the socket 57'.The rod 59 also threadably receives a pair of nuts 61. A compression spring 62 is received about the rod 59 between the nuts 61 and a socket or socket section 63. The nuts 61 are adjusted so that the spring 62 is always under some compression irrespective of the position of the crank pin 56. The rod 59 has an enlarged section 64 received in an elongated recess 65 in the socket 63, thereby permitting relative movement between the rod 59 and the socket 63. The socket 63 movably mounts a ball 66 in a socket hole 67. The ball 66 has a hole 68 in which a shaft 69 is received. The shaft 69 is rigidly connected to the platen assembly 33. Before the clutch 51 is engaged, shaft 56 is in the phantom line position indicated at 56' in FIG. 3. In this position, the platen 44 of the platen assembly 33 is spaced from printing members 70 of the print head assembly 32. As the shaft 52 rotates clockwise (FIG. 3), the platen assembly 33 continues to move away from the print head asembly 32 until the crank pin 56 rotates clockwise to its lowerest position (FIG. 3). As the shaft 52 continues to rotate clockwise, the platen assembly 33 starts moving toward the print heat assembly 32. Before the crank 56 reaches the highest position shown by solid lines in FIG. 3, stop screws 71 engage a stop provided by a stop plate 72 rigidly mounted to the frame 31 by a bracket 73. The bracket 73 is considered to be part of the frame 31. While the stop screws 71 are in contact with the stop plate 72 the record member is in contact with the printing members 70. The stop screws 71 are adjustable to effect adjustment of impression control.

Figures 5, 6:
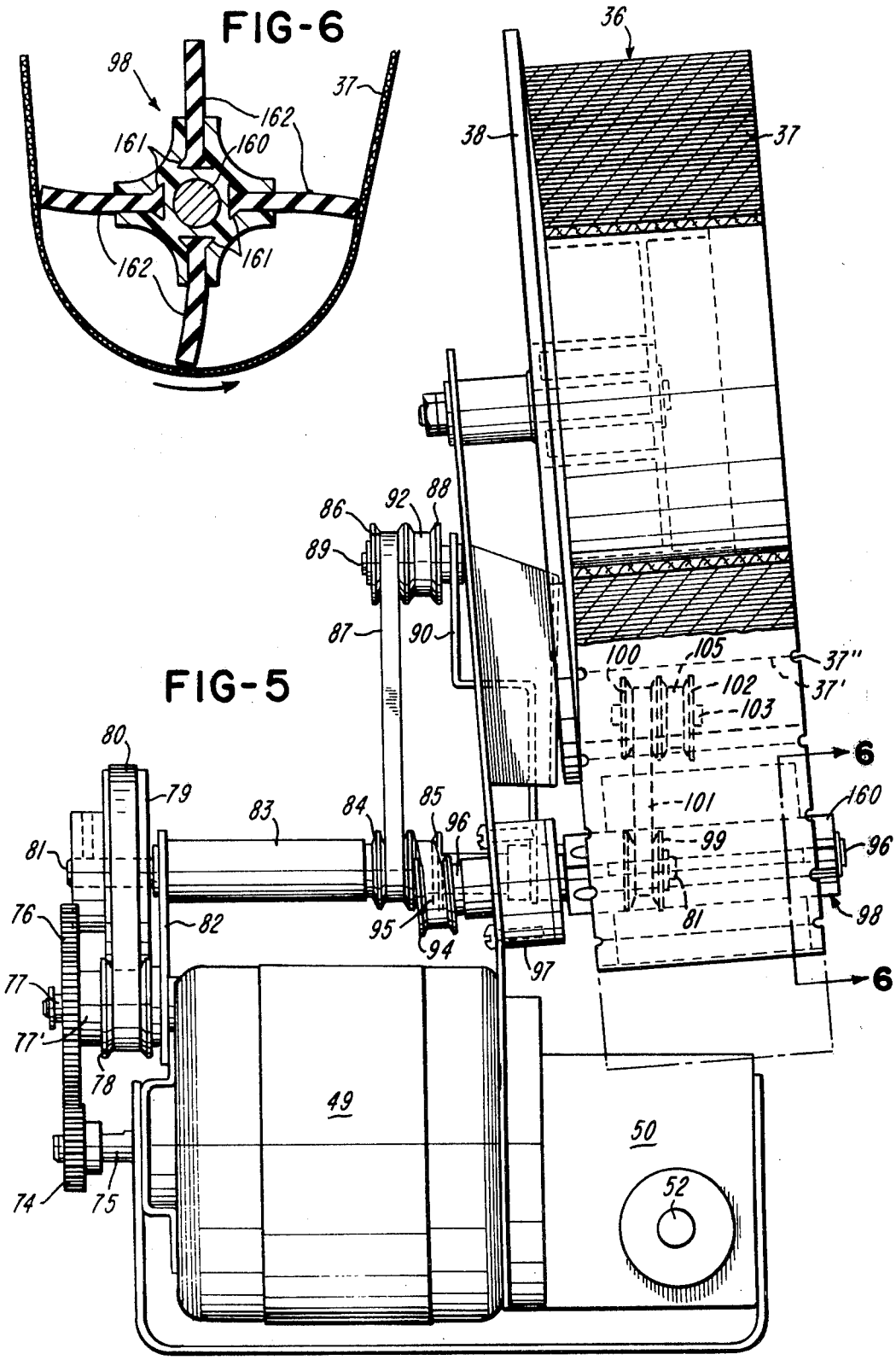
FIG. 5 is a rear elevational view taken along line 5—5 of FIG. 1.
FIG. 6 is a sectional view taken along line 6—6 of FIG. 5.
Figure 15:
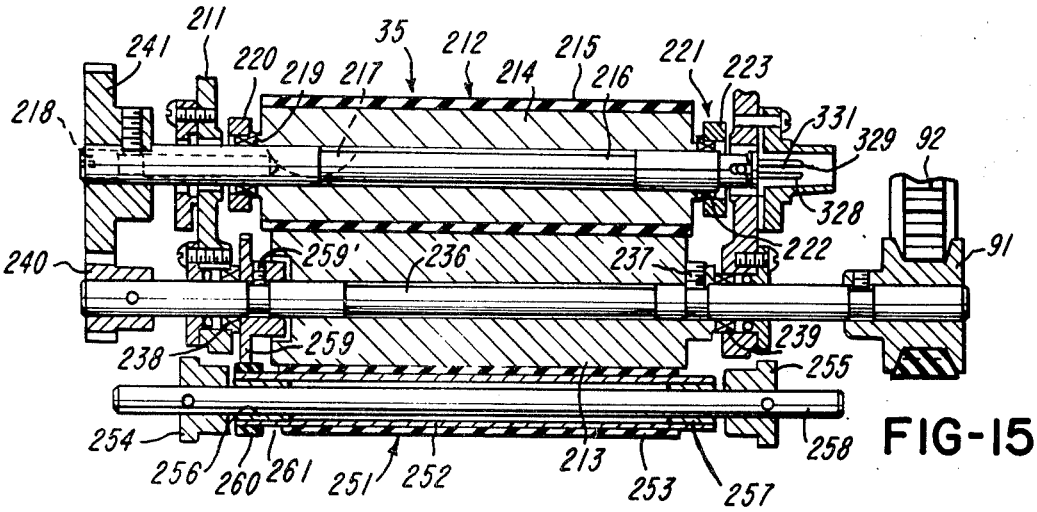
FIG. 15 is a sectional view taken generally along line 15—15 of FIG. 14.
Figure 22:
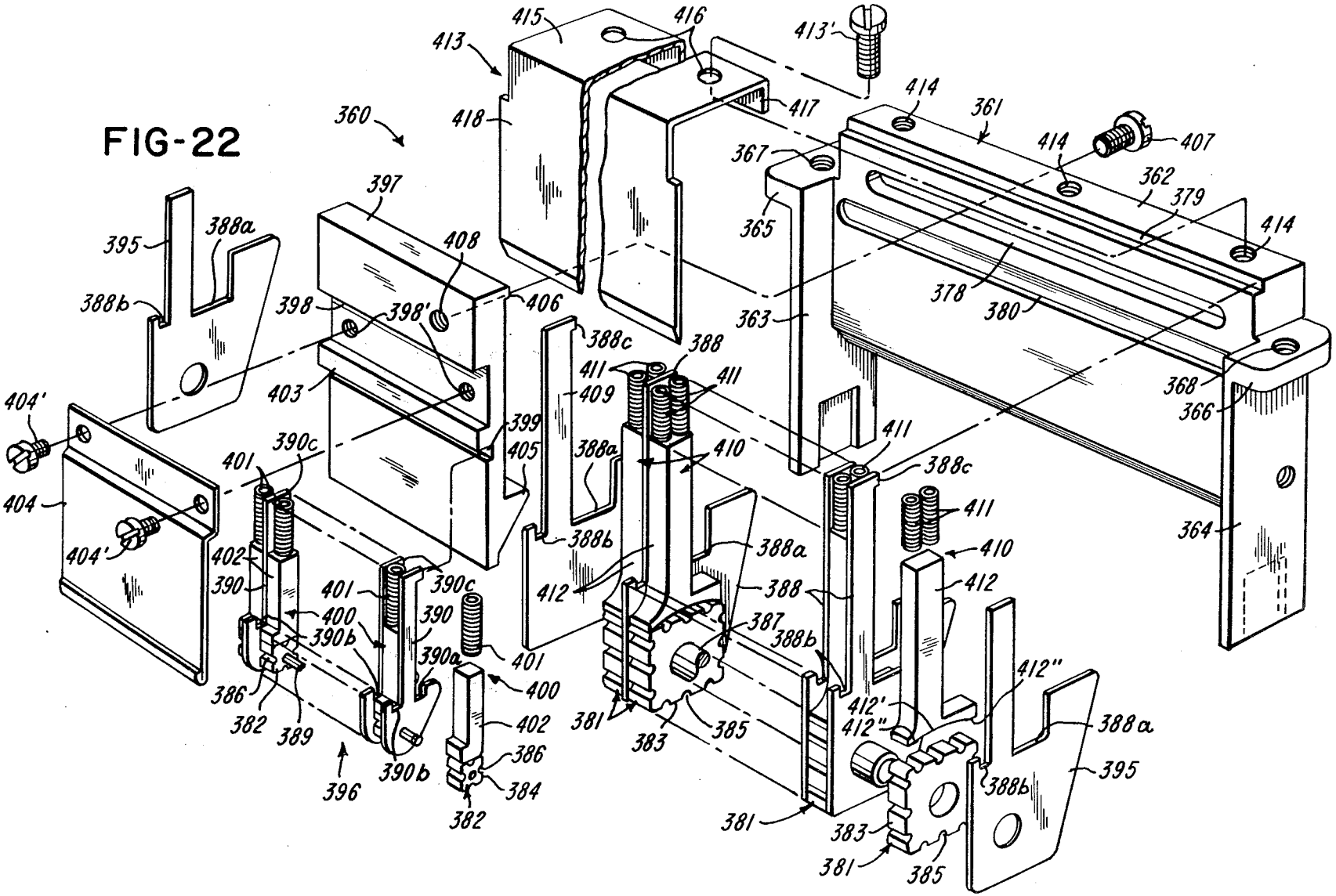
FIG. 22 is an exploded perspective view of the modular printing band support assembly shown in FIG. 21.

With reference to FIGS. 1 and 5, the electric motor 49 has a gear 74 secured to its output shaft 75. The gear 74 drives a gear 76 secured to a pulley 78. The gear 76 and the pulley 78 are rotatably mounted on a shaft 77. The pulley 78 drives a pulley 79 via belt 80. The pulley 79 is secured to a shaft 81. A bracket 82 secured to the frame 31 mounts the shaft 77 and a stationary bearing 83. The gear 76 and the pulley 78 are secured to a hub member 77'. The shaft 81 is rotatably mounted by the bearing 83 and drives pulleys 84 and 85 and 99. The pulley 84 drives a pulley 86 via belt 87. The pulley 86 and a pulley 88 are keyed together so that they rotate as a unit about stationary shaft 89. The shaft 89 is secured to the frame 31 by a bracket 90. The pulley 88 drives a pulley 91 (FIG. 15) via belt 92. The pulley 91 drives the mechanism 35.

The pulley 85 (FIG. 5) drives a pulley 94 via belt 95. The pulley 94 is secured to a shaft 96 rotatably mounted by a bearing 97. A rotary frictional feed member 98 is secured to the shaft 96.

A pulley 99 secured to the shaft 81 drives a pulley 100 via belt 101. The pulley 100 and another pulley 102 are keyed together so that they rotate as a unit about a stationary shaft 103. The pulley 102 drives a pulley 104 (FIGS. 18 and 19) via belt 105. As best shown in FIGS. 18 and 19, the pulley 104 drives the record feeding mechanism generally indicated at 107.

With reference to FIG. 18, the platen assembly 33 is shown to be comprised of a platen frame 108 in which the shaft 103 is adjustably mounted to tension the belt 105. The tension on the belt 101 is maintained by a pair of springs 109 (FIGS. 2 and 18). A pair of plates 110 and 111 are shown to be mounted in spaced parallel fixed relationship with respect to each other by spacer rods 112, 113 and 114 The ends of the rods 112, 113, and 114 are suitably secured to the plates 110 and 111 to provide a unitary feed assembly frame 115. The plates 110 and 111 of the feed assembly frame 115 are pivotally mounted by studs 116 and 117 carried by a bracket 33' secured to the platen frame 108. The studs 116 and 117 pivotally mount the solenoid housing 157. The entire feed assembly frame 115 is accordingly pivoted by the studs 116 and 117 with respect to the platen frame 108. The plate 110 is shown to be in abutment with a stop screw 118 threadably mounted by the platen frame 108. The top screw 118 adjustably limits the position to which the feed assembly frame 115 can be pivoted by a tension spring 119, thereby adjusting the amount of pressure which the feed wheel 42 exerts on the underside of the record web. The tension spring 119 is connected at one end to the rod 114 and at its other end to the platen frame 108.

With reference to FIG. 19, there is shown a wrapped-spring clutch generally indicated at 120. The clutch 120 includes a tubular sleeve 121 having a flat 122. The pulley 104 matingly receives the sleeve 121 at the flat 122 so that the pulley 104 and the sleeve 121 rotate as a unit. An annular tubular drive member 123 is press-fitted onto the sleeve 121 so that the sleeve 121 and the drive member 123 rotate as a unit. A control sleeve 124 is received about the drive member 123. The sleeve 124 can be constructed of suitable plastic material. The sleeve 124 has an annular external groove 125 which receives a resilient O-ring 126, composed of a material having a relatively high co-efficient of friction such as rubber. As the 0-ring 126 is snugly received in the groove 125 in a slightly stretched condition, the 0-ring 126 does not rotate relative to the sleeve 124. An output driven member generally indicated at 127 has an enlarged annular section 128, the diameter of which is illustrated as being equal to the diameter of the drive member 123. The feed wheel 42 is shown to be formed integrally with the enlarged annular section 128. A spring 130 is shown to be received about a portion of the outer surface of the drive member 123 and about the outer surface of the annular section 128. One end of the spring 130 is turned out to provide a tang 131 received in an open-ended slot 132 in the sleeve 124. The sleeve 124 is shown to have an enlarged internal diameter as indicated at 133 to provide clearance between the spring 130 and the sleeve 124. The output drive member 127 has a reduced diameter section 134 which extends through the sleeve 121, a spacing and retaining sleeve 135, a bushing 136, washers 137 and 138, an 0-ring 139, and into the knob 140. The output driven member 127 also has a stub end 141 received by a bushing 141. The bushing 142 is non-rotatably mounted by the plate 111. A set screw 143 threadably mounted by the sleeve 134 and received in a groove 144 of the section 134 prevents the driven member 127 from shifting in a direction perpendicular to the plates 110 and 111, but allows the member 127 to be rotated. The bushing 136 is non-rotatably mounted by the plate 110. In the solid line position shown in FIGS. 18 and 19, a control member 145 is shown to have a pair of blunt, spaced-apart teeth 146; the control member 145 is shown in contact with the O-ring 126, thereby holding the sleeve 124 and the spring 130 uncoiled or expanded so that it has a larger internal diameter than when the clutch 120 is engaged. As the pulley 91 rotates continuously, the sleeve 121 and the drive member 123 rotate continuously relative to the sleeve 124 and the spring 130. While the control member 145 is in contact with the O-ring 126, the spring 130 is expanded thereby preventing the drive member 123 from driving the annular section 28 of the output member 127. When the control member 145 is moved to the phantom-line position (FIG. 18) out of contact with the O-ring 126, the spring 130 coils up, that is, its internal diameter is reduced, thereby gripping the drive member 123. The clutch 120 is now engaged as the spring 30 drivingly connects the input member 123 and the output member 127. When the clutch 120 is engaged, the feed wheel 42 rotates. The web of record members 37 is fed between the feed wheel 42 and a roll 43 which is rotatably mounted in a block 148 by a bearing 150. The block 148 is suitably mounted to the platen frame 108. The outer surface of the feed wheel 42 is provided with straight knurls 42' which engage the underside of the web of record members 37. The feed wheel 42 is considerably narrower than the width of the web being fed. However, the roll 43 is long enough to engage the upper surface of the web across a considerable portion of its width. Thus, the roll 43 serves to hold the web down against the upper surface of the platen frame 108 immediately upstream of the platen 44. When the control member 145 is moved to the phantom line position (FIG. 18) out of contact with the O-ring 126, the rotation of the O-ring 126, the sleeve 124, and the spring 120 is arrested, thereby causing the spring 130 to uncoil or expand. Uncoiling of the spring 130 effects disengagement of the clutch 120 by causing the spring 130 to move outwardly away from the outer surface of the drive member 123. Accordingly, the feed wheel 42 is no longer driven and the movement of the web of record members 37 stops. It is noted that the control member 145 contacts the O-ring 126 above the center of the control sleeve 124 at an obtuse angle A relative to the direction of travel of the O-ring at the point of contact. Moreover, considering a first line between the point of contact and the pivot 123, a second line perpendicular to the first line and intersecting the first line between the point of contact and the pivot 113 passes through the center line of the sleeve 124. This results in effective disengagement at the clutch 120 when the member 145 contacts the O-ring 126.

The end section 149 of the driven member 127 has a flat 150'. The knob 140 is received by the end section 149 and has a flat 151 which cooperates with the flat 150 of the end section 149 to prevent rotation of the knob 140 relative to the end section 149. A friction clutch 152 includes the washer 138 which is keyed to the section 149, the O-ring 139, the washer 137 and the end surface of the bushing 136. A screw 153 threadably received by the end section 149, is adjustable to adjust the amount of frictional drag of the clutch 152. It is apparent that the feed wheel 42 can be driven either through torque applied by the pulley 104 when the clutch 120 is engaged, or manually by rotation of the knob 140 but the clutch 152 frictionally holds the feed wheel 42 in the position into which it has been advanced, either as a result of the engagement of the clutch 120 or as the result of manually rotating the knob 140.

A solenoid 154 (FIG. 18) mounted by the platen frame 108 has an armature 15. A compression spring 156 is received about the armature 155 between the end of the solenoid housing 157 and a flange 158 on the armature 155. The armature 155 is connected to the control member 145 by a pin 159. The spring 156 normally holds the control member 145 in the solid line position (FIG. 18). Energization of the solenoid 154 causes the armature 155 to shift, thereby pivoting control member 145 clockwise into the phantom line position (FIG. 18) out of contact with O-ring 126. Energization and deenergization of the solenoid 154 is controlled by a circuit shown in FIG. 30.

The feed wheel 42 advances the web once during each machine cycle so that a record member 37 is presented to the printing position or zone between the platen 44 and the printing members 70. When the record member 37 arrives at the printing zone, the clutch 120 is disengaged and the feed wheel 42 stops rotating. However, as the output shaft 75 of the electric motor 49 rotates continuously, the rotary feed member 98 is continuously driven. The rotary feed member 98 is shown in FIGS. 5 and 6 to have a hub 160 secured to the driven shaft 96. The hub 160 is shown to be provided with four dove-tail slots 161 for receiving respective drive members 162. The drive members 162 are in the form of outwardly extending vanes or blades. The drive members 162 are composed of a flexible, resilient material preferably having a high co-efficient of friction, such as rubber. When the drive members 162 are in driving engagement with a section of the web which has been paid out of the roll 36, the drive members 162 flex slightly as they engage the web. As the rotary feed member 98 continues to rotate, additional web material is paid out of the roll 36 until gradually slackness develops. As the slackness increases, the contact between the rotaty feed member 98 and the web decreases and it can decrease to such an extent that the paid out web section looses contact with the feed member 98 as indicated by phantom lines. As rotation of the rotary feed member 98 continues, the feed wheel 42 and the roll 43, together with the feed member 98 provides a simple arrangement for feeding the web material from the roll 36. As the roll 36 has a relatively large amount of inertia, and as the feeding by the feed wheel 42 is intermittent, the construction, arrangement and location of the feed member 98 prevents an undue amount of web material from being paid out of the roll 36. This is accomplished without applying any braking force either to the reel 38, to the roll 36, or to the paid out web material, although the art is replete with such devices. As best shown in FIG. 5, it is noted that the reel 38 and the rotary feed member 98 are disposed at the same slight angle with respect to the horizontal.

Figure 7:
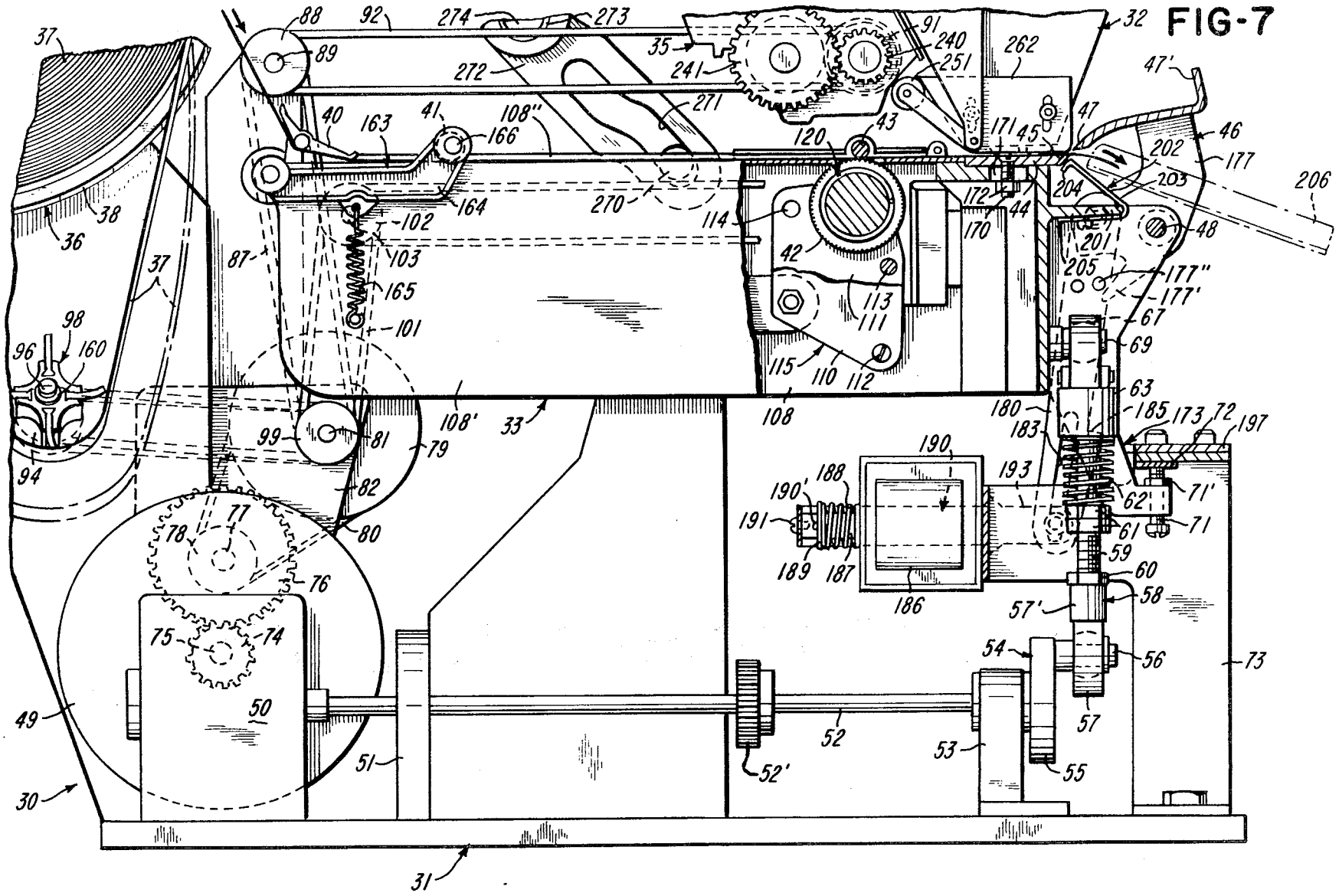
FIG. 7 is a sectional view taken along line 7—7 of FIG. 2.

Assuming the apparatus is mounted on a generally horizontal surface, the roll 36 will not come off the reel 38 and yet the rotary feed member 98 can make full contact with the underside of the web. The peripheral speed of the drive members 162 is greater than the peripheral speed of the feed wheel 42. With reference to FIGS. 2 and 7, there is provided an aligning mechanism generally indicated at 163. The aligning mechanism 163 includes an arm 164 pivotally mounted by the pivot pin 34. A tension spring 165 is connected at one end to the arm 164 and at its other end to a plate 108' secured to the platen frame 108. A shaft 166 secured to the arm 164 is disposed at a slight angle with respect to the direction of travel of the record members 37 and to a plate 108'' secured to the platen frame 108. An aligning roll 41 is comprised of a bushing 167 rotatably mounted by the shaft 166 and a one-piece molded annular frictional member 168 having a plurality of external annular flanges 169. The spring 165 urges the roll 41 toward platen surface 39. As the web advances, the web rotates the roll 41 which causes the web to move into alignment with an upstandng guide edge provided by the plate 108''.

The platen 44 is shown in FIG. 7 to be adjustably mounted to the platen frame 108 by screws 170. The screws 170 pass through elongated slots 171 in the platen frame 108 and are rotatably received by respective nuts 172. In this manner, the platen 44 and the knife 45 formed at the terminal end of the platen 44 can be adjusted relative to the movable knife 47.

A bracket 173 is suitably secured to the platen frame 108. The bracket 173 threadably receives the adjusting screws 71. Lock nuts 71' lock the respective screws 71 in their adjusted positions. The bracket 173 mounts pivot 48. The movable knife 47 has a pair of flanges or arms 176 and 177 which are pivotally mounted by the pivot 48. A link 178 is connected to the arm 176 by a pivot pin 179, and a link 180 connected to the arm 177 by a pivot pin 181. The links 178 and 180 are identical and have respective elongated slots 182 and 183 and respective stop shoulders 184 and 185. A solenoid 186 is secured to the bracket 73. Armature 187 (FIG. 7) is shown to be received in a compression spring 188. The spring 188 is compressed between the end of the solenoid 186 and a washer 189 which bears against a pin 190'. A generally U-shaped yoke 190 secured to the end of the armature 187 by a screw 191 has a pair of forwardly extending arms 192 and 193. The arm 192 is pivotally connected to the link 178 by a pivot pin 194, and the arm 193 is pivotally connected to the link 180 by a pivot pin 195. Arms 192 and 193 have respective stop shoulders 192' and 193'.

The severing mechanism 46 is only effective when the solenoid 186 has been energized. The solenoid 186 is energized during the time in the machine cycle when the shoulders 184 and 185 are below a stop face 196 provided by a plate 197 secured to the bracket 73. Energization of the solenoid 186 drives the links 178 and 180 against the end 198 of the plate 197. As the platen assembly 33 moves upwardly, the shoulders 184 and 185 of the respective links 178 and 180 engage the stop face 196 (FIG. 8) to pivot the movable knife 47 counterclockwise into severing cooperation with the knife 45, thereby severing a record member 37 from the web. During the remainder of the machine cycle, the platen assembly 33 moves away from the print head 32. Upon deenergization of the solenoid 186, the springs 199 and 200 respectively connecting the link 178 and the bracket 173, and the link 180 and the bracket 173 cause the movable knife 47 to pivot to its clockwise position shown in FIG. 9.

The spring 188 normally holds the yoke 190 and the pins 194 and 195 in the position shown for example in FIG. 7. Assuming that the solenoid 186 is not energized, the shoulders 184 and 185 will not engage the stop face 196 as the platen assembly 33 moves upwardly. Accordingly, the movable knife 47 will remain in its initial position relative to the knife 45 (FIGS. 1 and 7).

The movable knife 47 has a manually engageable upstanding tab or handle 47' by which the movable knife 47 can be moved into record severing relationship with respect to the knife 45. As the movable knife 47 pivots, the slots 182 and 183 allow the links 178 and 180 to be moved downwardly as viewed in the drawings. The springs 199 and 200 thereafter return the movable knife 47 to its initial position shown in FIGS. 1 and 7. Flange 177 has a projection 177' which is urged into control with a top 177'' by springs 199 and 200 to define the initial position.

With reference to FIGS. 3 and 7, the bracket 173 is shown to have an extension 201. A resilient deflector generally indicated at 202 includes inwardly and upwardly extending spring fingers 203 which in their normal positions extend to immediately adjacent and slightly below the cutting edge of the knife 45. The marginal ends 204 of the spring fingers 203 are turned away from the edge of the knife 45. The spring fingers 203 are integrally joined to a mounting portion 205 disposed in underlying relationship to the extension 201. Screws 206 secure the mounting portion 205 to the extension 201. When the movable knife 47 is actuated into cutting relationship with the knife 45 to sever a record member 37 from the web, the movable knife 47 deflects the spring fingers 203 from the position shown in FIG. 7 to the position shown in FIG. 8. As the movable knife returns from the position shown in FIG. 8 to the position shown in FIG. 7, the spring fingers 203 also return to the position shown in FIG. 7. The fingers 203 not only prevent the severed record member 37 from falling out of reach in the apparatus 30, but they also serve to propel the individual record members into a discharge chute indicated by phantom lines 206 in FIG. 7. The chute 206 is disposed between arms 176 and 177 of the movable knife 47.

Figure 13:
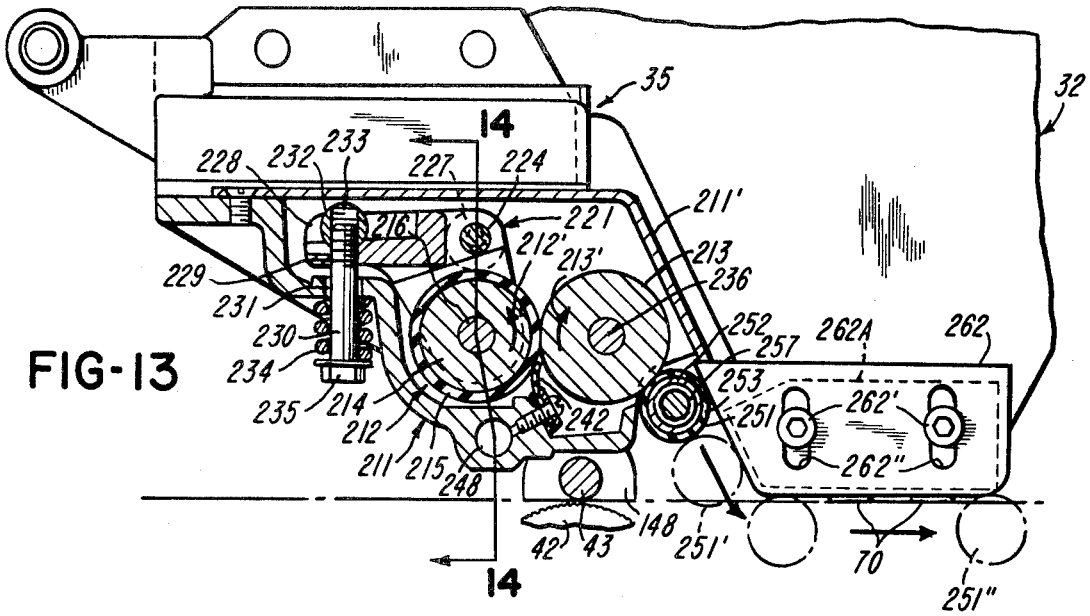
FIG. 13 is a fragmentary elevational view showing the inking mechanism in section.

Referring to FIGS. 11 and 13 through 17, and initially to FIG. 13, there is shown the inking mechanism generally indicated at 35. The inking mechanism 35 includes a reservoir or fountain 211 by which an ink supply roll 212 and an ink transfer roll 213 are mounted. The ink transferring roll 213 is an anilox roll having typically microscopic geometric shaped holes or cells in its surface. These holes or cells carry the ink to an ink roll 251. The fountain 211 has a fountain cover 211'. The ink supply roll 212 has a hub 214 and an ink receptive cover 215 made of rubber. The hub 214 is keyed to a shaft 216 by a key 217. A screw rod 218 threadably received by the shaft 216 is shown to be tightened to drive the key 217 into keying engagement with the hub 214. The shaft 216 is rotatably mounted near one end by a bearing 219 in an arm 220 of a U-shaped frame generally indicated at 221. The shaft 216 is also mounted near its other end by a bearing 222 received by the other arm 223 of the U-shaped frame 221. The frame is pivotably mounted by a shaft or pivot 224 mounted at opposed ends 225 and 226 by the fountain 211. A set screw 227 prevents the frame 211 fron shifting axially along the shaft 224.

The frame 221 has an extension 228 with a hole 229. A screw 230 passes through a hole 231 in the fountain 211 and the hole 229 in the extension 228. A rod 232 having a threaded bore 233 threadably receives the screw 230. A compresion spring 234 is received about the screw 230 between the screw head 235 and the fountain 21. Tightening the screw 230 causes the ink supply roll 212 to be pressed more tightly against the ink transferring roll 213, thereby diminishing the amount of ink which is transferred to the ink transferring roll 213 by the ink supply roll 212. Loosening the screw 230 results in more ink being transferred to the ink transferring roll 213.

The ink transferring roll 213 is secured to a mounting shaft 236 by a set screw 237. The shaft 236 is rotatably mounted in bearings 238 and 239. The shaft 236 is driven by the pulley 91. A pinion 240 secured to the shaft 236 is in meshing engagement with a gear 241 secured to the shaft 216. As the external diameter of the ink supply roll 212 and the ink transferring roll 213 are the same, the gears 240 and 241 cause the ink supply roll 212 to be driven at a slower rate of speed than the ink transfer roll 213. This difference in the peripheral speeds of the rolls 212 and 213 results in a slight wiping action or slippage as the rolls 212 and 213 rotate in the directions of arrows 212′ and 213′ (FIG. 13). This wiping action is found particularly beneficial with inks of relatively high viscosities in effecting diminuation in the amount of ink transferred to the ink transferring roll 213. As the amount of pressure adjustment between the rolls 212 and 213 is relatively small upon the loosening or tightening of the screw 230, the correct meshing engagement between the gears 240 and 241 is not affected.

Figure 17:
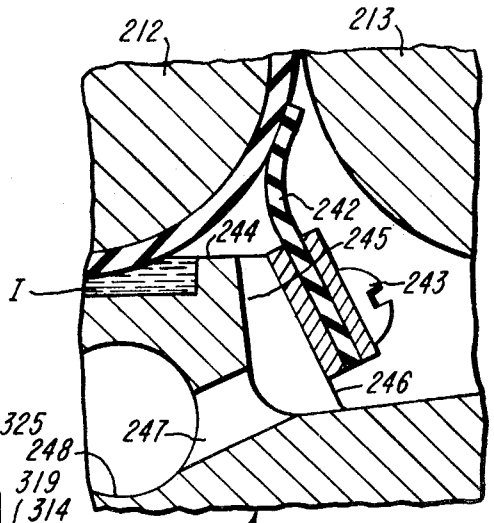
FIG. 17 is a fragmentary sectional view on an enlarged scale showing a wiper blade and ink return ducts and a header.

A wiper blade 242 secured to the fountain 211 is slightly longer and thus extend slightly beyond both ends of the roll 212. The blade 242 both limits the amount of ink which is transferred to the roll 213 and distributes the ink relatively evenly over the surface of the roll 212. As best shown in FIG. 17, the amount of ink I in the fountain 211 is limited by a weir 244. Excess ink in the fountain 211 pours over the weir 244 and gravitates through openings 245 between a plurality of bosses 246 which receive screws 243. From openings 245 the ink flows gravitationally through a plurality of drain holes 247 (one of which is shown) into ink return header 248 from which the excess ink is returned via flexible tube 250 to a sump in the form of a glass jar 249.

An ink roll 51 is shown in FIG. 13 to be in inking cooperation with the ink transfering roll 213. The ink roll 251 includes a tubular sleeve 252 having a covering 253 of ink receptive material such as rubber. Guide rollers 252 and 255 are secured to a shaft 258. The sleeve 254 is rotatable on the shaft 258 by bearings 256 and 257.

A knurled wheel 259 is secured to the shaft 236 by a set screw 259′. The wheel 259 drivingly engages an annular rubber wheel 260 secured to the sleeve 252 when the roll 251 is in inking relationship with the roll 213 as shown in FIG. 13. A gap 261 between the covering 253 and the wheel 260 to prevent any ink from being transferred to the wheel 260 from the covering 253.

Figure 11:
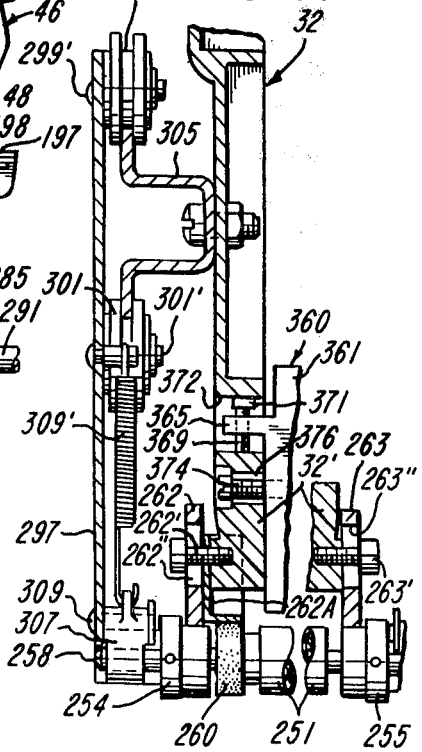
FIG. 11 is a sectional elevational view showing the manner in which the ink roll is mounted for travel relative to the print head assembly.

With reference to FIG. 11, the rolls 254 and 255 are shown to be in contact with guide means in the form of respective cams 262 and 263. The diameter of the wheel 260 is slightly larger than the diameters of the rolls 254 and 255. The wheel 260 is shown to be in contact with a plate 262A the lower surface of which is spaced slightly above the lower surface of the cam 262 as viewed in FIG. 11. The ink roll 251 is normally in position shown by phantom lines 251′ in FIG. 13. As the platen assembly 33 pivots downwardly, the ink roll 251 is driven from the position shown by phantom lines 251′ to the position shown by phantom lines 251″. The cam tracks 262 and 263 can be individually and independently adjustable upwardly and downwardly relative to the printing members 70 carried by the print head assembly 32. Adjustment of the cam tracks 262 and 263 by screws 262′ and 263′ which extend through enlarged slots 262″ and 263″ adjusts the amount of pressure or inking contact between the roll 251 and the printing members 70, thereby controlling the application of ink to the printing members 70. While the ink roll 251 is moving from the position shown by phantom lines 251′ to the position shown by phantom lines 251″, the ink roll 251 is driven by the plate 262A which is in driving engagement with the wheel 260. The fact that the wheel 260 has a slightly larger diameter than the covering 253 of the ink roll is of no practical consequence in that the contact area between the printing member 70 and the covering 253 is many times greater than the contact area between the plate 262A and the wheel 60. Accordingly, the ink roll 251 rolls across the printing members 70 without slipping.

Figure 9:
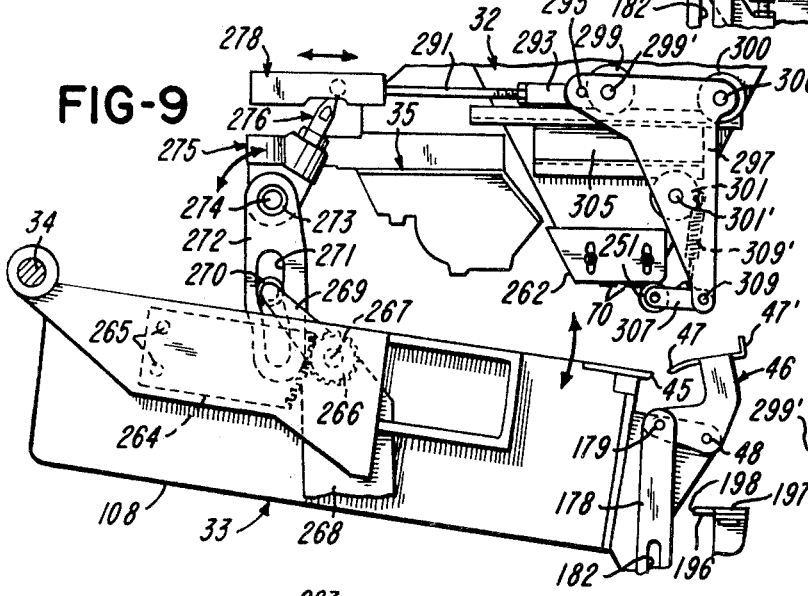
FIG. 9 is a fragmentary side elevational view similar to FIG. 8, but showing the ink roller as having inked the printing members during its forward stroke and showing exaggeratedly the platen in its downward position.

With reference to FIG. 1, a gear section 264 specifically in the form of a gear segment, the center of rotation of which is the axis of the pivot 34, is secured to the platen frame 108 by screws 265. Accordingly, the rack 264 rotates as a unit with the platen frame 108. A pinion 266 is secured to a shaft 267 pivotally mounted in a stationary bracket 268. The bracket 268 is secured to the frame 31. An arm 269 secured to the shaft 267 carries a roller 270. With reference to FIG. 9, as the platen assembly 33 moves generally downwardly, the rack 264 drives the pinion 266 and the arm 269 counterclockwise. The roller 270 is received in a cam slot 271 of a cam follower 272. The follower 272 is secured to a shaft 274 pivotal about a bearing 273 suitably secured to the frame 31. A rocker 275 secured to the shaft 274 carries a spaced apart pair of ball joints 276 and 277. The ball joint 276 and 277 are received by respective sockets 278 and 279 are identical in construction. Accordingly, only the ball joint 277 and its respective socket 279 are shown in detail in FIG. 10.

Figure 10:
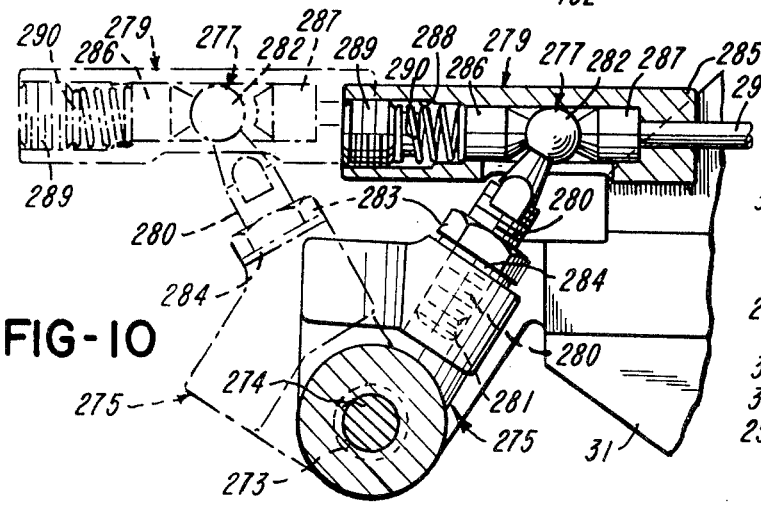
FIG. 10 is a fragmentary view showing part of the linkage of the inking mechaism in both solid and phantom line positions.

With reference to FIG. 10, the ball joint 277 is shown to have a threaded shank 280 threadably received in a threaded bore 281 in the rocker 275. The ball joint 277 includes a spherical ball 282 joined to the shank 280. The distance between the ball 282 and the centerline of the shaft 274 can be varied by turning the ball joint 277. This changes the length of the arc through which the ball 282 travels. A lock nut 283 and washer 284 lock the shank 280 in its adjusted position. The socket 279 includes a housing 285 and an opposed pair of socket members 286 and 287. The housing 285 has a threaded bore 288 which receives a screw 289. A compression spring 290 is compressed between the socket member 286 and the screw 289. The socket member 287 is suitably rotatably mounted in the housing 285, but the socket member 286 is slidable generally to the left (FIG. 10) away from the socket member 287 to further compress the spring 290 as shown by phantom lines in FIG. 10 during the inking of the ink roll 251.

Rods 291 and 292 are suitably secured at their one ends to the socket member 287 of the respective sockets 278 and 279. The other ends of the rods 291 and 292 are threadably received by respective connectors 293 and 294. The connectors 293 and 294 are connected by pivot pins 295 and 296 to respective carriages 297 and 298. The carriage 297 (FIG. 8) rotatably mounts rollers 299, 300 and 301 by respective pivot pins 299', 300' and 301'. The carriage 298 (FIG. 1) rotatably mounts rollers 302, 303, and 304 by respective pivot pins 302', 303' and 304'. The rollers 299, 300 and 301 are in guided rolling contact with a guide track 305 shown in detail in FIG. 11. The rollers 299, 300 and 301 make three-point contact with the track 305. The rollers 302, 303, and 304 are in guided, rolling, three-point contact with a guide track 306 (FIG. 1). Links 307 and 308 are mounted to carriages 297 and 298 by respective pivots 309 and 310. The opposite ends of the shaft 258 are mounted by the arms 307 and 308. Springs 309' and 310' connected to respective links 307 and 308 and carriages 297 and 298 urge rollers 254 and 255 against respective cam tracks 262 and 263.

Figure 16:
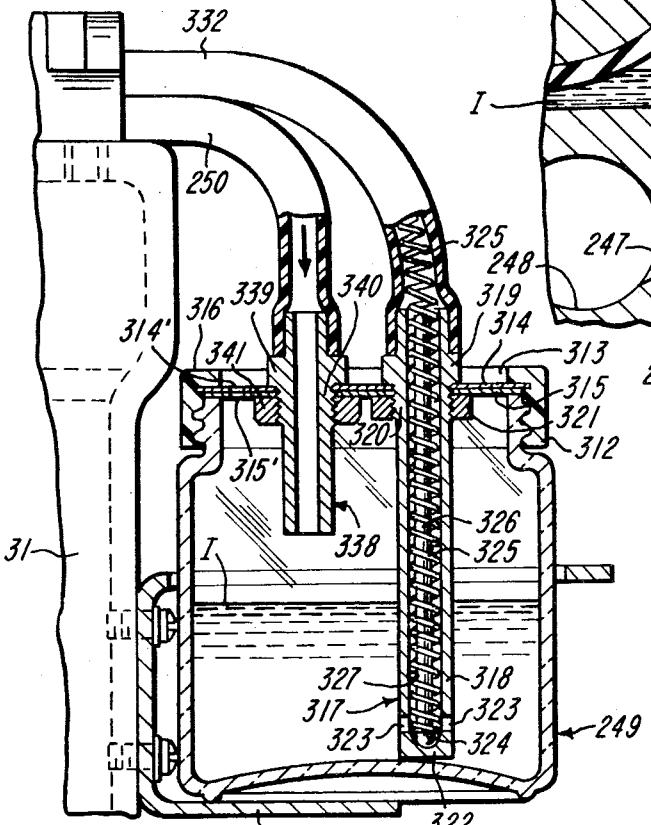
FIG. 16 is a sectional elevational view of apparatus by which ink is delivered to the fountain from the sump and excess ink is returned to the sump.
Figure 12:
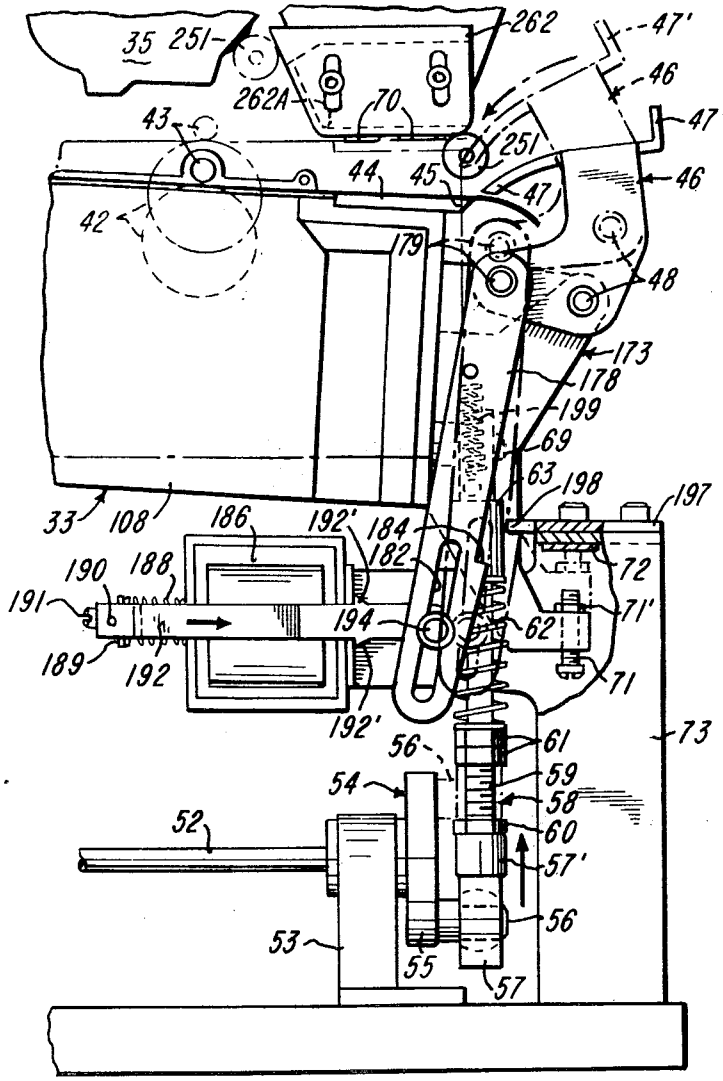
FIG. 12 is an enlarged fragmentary elevational view illustrating the severing mechanism in both solid and full line positions.

With references to FIG. 16, the jar 249 is mounted by a holder 311 secured to the frame 31. A cap 312 is threadably secured to the jar 249, The cap 312 has a large opening 313. A metal plate 314 and a compressible liner 315 are clamped between end wall 216 of the cap 312 and the terminal end of the jar 249. A pump generally indicated at 317 is shown to include a tubular pump body 318. The pump body 318 has an enlarged external diameter section or flange 319 and a threaded section 329. A nut 321 received by the threaded section 320 bears against the line 315 and draws the flange 319 against the plate 314 to mount the pump in an upright position. Spaced slightly above the lower terminal end 322 of the pump body 318 are a plurality of inlet ports 323. A ball 324 is received in a recess in the lower end of the pump body 318. A helical spring 325 receives a rod 326. One end of the spring 325 contacts the ball 324 which acts as a bearing for the spring 325. The other end of the rod 326 extends to about the end of the pump body 318. The spring 325 exerts a gripping force in the rod as the outside diameter of the rod 326 is greater than the internal diameter of the spring 325 before the rod 326 is inserted into the spring 325. Accordingly, the spring 325 and the rod 326 are rotatable as a unit. There is only a slight amount of clearance between outside of the spring 325 and the inside bore 327 of the pump body 318. The spring 325 extends all the way from the lower end of the rod 326 (FIG. 16) to the slotted marginal end 328 (FIG. 15) of a connector 329 secured to the shaft 216. The end of the spring 325 has a tang 330 which extends into the slot 331 of the slotted end 328, thereby connecting or keying the spring 325 to the connector 329. As the shaft 216 and the connector 329 rotate the spring 325 rotates within a flexible plastic tube 332. The flexible tubes 250 and 332 are curved and the spring 325 conforms generally to the internal contour of the tube 332. The portion of the spring 325 in the bore 327 is not in the same axis as the drive shaft 216. The tube 332 is received about a tubular extension 333 of the fountain 21. A wire stiffener 334 is wrapped about the marginal end portion 335 of the tube 332. The stiffener 334 insures that the portion 335 of the tube 332 between the upper and lower passes 92' and 92'' of the continuously moving belt 92 does not come into contact with the belt 92. Similarly, a wire stiffener 336 is wrapped about the marginal end portion 337 of the tube 250. The stiffener 336 insures that the portion 337 of the flexible tube 250 does not come into contact with the lower pass 92'' of the belt 92.

The lower end of the tube 250 is connected to a tubular fitting 338 (FIG. 16). The fitting 338 has a flange 339 and a threaded section 340. A nut 341 secures the fitting 338 to the plate 314.

Figure 14:
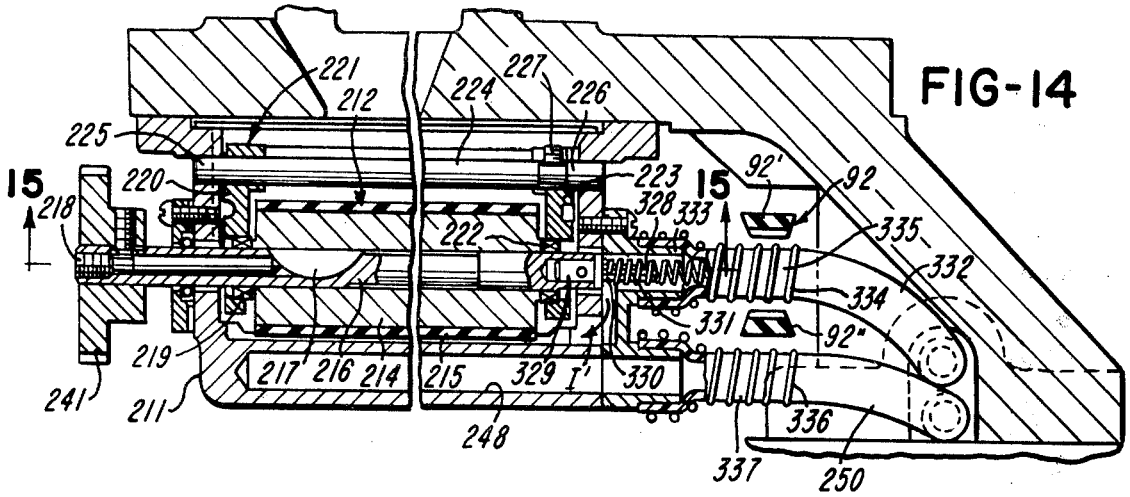
FIG. 14 is a sectional view taken generally along line 14—14 of FIG. 13.

With reference to FIG. 14, as the shaft 216 rotates continuously, the spring 325 is also continuously rotated within the flexible tube 332. The spring 325 extends into the tubular pump body 318 and rotates together with the rod 326. The rod 326 fills up the space within the coils of the springs 325. As the spring 325 rotates, ink I in the jar 249 is drawn through the inlets 323. As the ink I has a relatively high viscosity, the ink I trapped between the rod 326 and the bore 327 of the pump body 318 and between the coils of the spring 325 is conveyed upwardly. The ink I in the tube 332 above the rod 326 completely fills the space in the tube 332 which is not occupied by the spring 325. Accordingly, the continuous rotation of the spring 325 causes ink to be delivered continuously through the pump body 318, through the flexible tube 332 and through the fitting 333 (FIG. 14) into the fountain 211 as indicated by arrow I'. The ink I supplied to the fountain 211 always exceeds the amount required so that excess ink is continuously returning through the header 248 to the jar 249 via the tube 250. The inside of the jar 249 is at atmospheric pressure because of aligned vent holes 314' and 315' in the plate 314 and the liner 315, respectively.

With references to FIG. 20, the print head assembly 32 is shown to include a pair of print heads 341 and 342 mounted by a print head assembly frame 32''. The frame 32'' is suitably secured to the machine frame 31. Each print head 341 and 342 rotatably mounts a respective series of drive wheels 343 and 344. The wheels 343 are in axial alignment with each other,and the wheels 344 are in axial alignment with each other. The wheels 343 and 344 are rotatably mounted by any suitable means such as stationary elongated bearings 345 and 346 rigidly secured to the print head assembly frame 32''. Toothed drivers or pinions 347 and 348 are secured to respective shafts 349 and 350. The shafts 349 and 350 are rotatably mounted by the print head assembly frame 32''. Manually engageable knobs 351 and 352 are secured to the respective shafts 349 and 350. By shifting the shaft 349 and its pinion 347 to the selected axial position by use of the knob 351, the pinion 347 is brought into meshing engagement with teeth 353 of the wheel 343 corresponding to a selected printing member 70 in the form of a selected endless printing band 354. Thereupon, manual rotation of the knob 351 causes the gear 347 to drive the selected wheel 343 to be driven to advance the respective printing band 354 to the selected position to print the selected data on the record member. By shifting the shaft 349 and thereafter rotating the shaft 349 each printing band 354 in the series or any one of them, can be set to print the desired data. There is a printing band 354 individual to and in engagement with each of the wheels 343. Each wheel 342 has about the same width as the associated band 354. The printing bands 354 are shown to be of the endless type and to have teeth 355 on their undersides in engagement in notches 356 on the periphery of the respective wheel 343. Similarly, by shifting the shaft 350 and its pinion 348 to the selected axial position by use of the knob 352, the pinion 348 is brought into meshing engagement with teeth 357 of the wheel 344 corresponding to a selected printing member 70 in the form of a selected endless printing band 358 or 358'. It is preferred to construct the printing bands 354, 358 and 358' of resilient material such as rubber. Therefore, manual rotation of the knob 352 causes the gear 348 to drive the selected wheel 344 to advance the respective printing band 358 or 358' to a position to print the selected data on the record member. By shifting the shaft 350 and the gear 348 and thereafter rotating the shaft 350 each printing bands 358 and 358' in the series, or any of them, can be set to print the desired data.

There is a support assembly generally indicated at 359 for the printing bands 354 and there is a support assembly generally indicated at 360 for the printing bands 358 and 358'. The support assembly 360 is shown in FIGS. 20 through 26. With reference initially to FIG. 23, the support assembly 360 is shown to be of modular construction. The assembly 360 is illustrated as having a support frame 361 with an elongated section 362 and integrally formed end plates 363 and 364, The frame 361 mounts a support assembly module generally indicated at 396.

Outwardly extending flanges 365 and 366 of the support frame 361 have respective threaded holes 367 and 368. Screws 369 and 370 (FIG. 21) threadably received in the respective holes 367 and 368 are used to adjust the tension on the printing bands 358 and 358' as best shown in FIG. 11. The head 371 of the screw 369 bears against a shoulder 372 of the one end plate 32' of the print head assembly 32. The head 373 bears against a similar shoulder (not shown) of the other end plate 32'. Accordingly, adjustment of the screws 369 and 370 will effect movement of the support assembly 360 toward or away from the wheels 344, that is, upwardly or downardly as viewed in FIG. 20. Once the support assembly 360 has been adjusted, screws 374 and 375 threadably received by the support frame 361 and which extend through an elongated slot 376 in one end plate 32' and an elongated slot 377 (shown only by phantom lines in FIG. 20) in the other end plate 32' are tightened to lock the support assembly 360 in the adjusted position.

Referring again to FIG. 22, the elongated section 362 of the support frame 361 has an elongated slot 378, an elongated notch 379, and an elongated groove 380. The space between the end plates 363 and 364 is occupied by support members specifically in the form of wheels 381 and by support members specifically in the form of wheels 383. The wheels 381 are square and have relatively long sides 383, while the wheels 382 are square and have relatively short sides 384. It is apparent that the sides 383 of each wheel 381 are relatively long in the plane of rotation of the wheel 381, and the sides 384 of each wheel 382 are relatively short in the plane of rotation of the wheel 382. It is further apparent that the radial dimensions of the wheel 381 are greater than the radial dimensions of the wheels 382. The sides 383 and 384 have respective notches 385 and 386. The wheels 381 are individually rotatably mounted by a shaft 387 mounted by mounting and spacing members 388 and 395. The members 388 are identical in construction and have notches **388*a* and 388*b* and a tang or projection 388*c*. The wheels 382 are individually rotatably mounted by a shaft 389 mounted by mounting and spacing members 390. The members 390 are identical and have notches 390*a* and 390*b* and a tang or projection 390*c*.**

As best shown in FIGS. 25 and 26, the printing bands 358 have relatively long printing blocks 391, while the printing bands 358' have relatively short printing blocks 392. One of printing blocks 391 of one printing band 358 is illustrated as having bar-shaped printing elements 393 for printing machine readable code data and a character element 394 for printing a corresponding human readable character; the remainder of this printing band 358 can have other and different bar-shaped and corresponding elements. If desired, the printing blocks 391 can carry large size character elements (not shown) for printing a large human readable character. It is apparent that the large printing blocks 391 and the small printing blocks 392 can print different sizes and types of data. The invention provides an arrangement by which the line can be composed of wheels 318 and wheels 382 in any arrangement. The printing blocks 391 and 392 which are supported by the respected wheels at the printing zone are disposed in a row to print a line of data and lie on a common plane. Shafts 387 and 389 are parallel and thus the axes of rotation of wheel 381 and 382 are parallel.

With reference again to FIG. 22, wheels 381 and members 388 and one end mounting member 395 occupy only part of the space between the end plates 363 and 364 of the support frame 361. The remainder of the space is occupied by the support assembly module 396.

The module 396 includes a module frame 397 having elongated grooves 398 and 399. Tangs **390*c* of the members 390 fit into the groove 399. Each wheel 382 is provided with a detent generally indicated at 400. Each detent 400 includes a compression spring 401 and a plunger 402. The one ends of the springs 401 abut an elongated flange 403 of the module frame 397, and the other ends of the springs 401 abut the ends of the plungers 402. A plate 404 is secured to the module frame 397 by screws 404' received in threaded holes 398'. The plate 404 retains the springs 401, the plungers 402 and the mounting and spacing members 390 in their assembled relationship as shown in FIGS. 21 and 24. With reference to FIG. 24, it is seen that the module frame 397 has an elongated projection 405 which fits against the lower end of the support assembly frame 361. The module frame 397 has an elongated projection 406 that fits into the notch 379 of the support assembly frame 361. The module 396 is secured to the support assembly frame by a screw 407 which extends through the slot 378 and is threadably received in a threaded hole 408 in the module frame 397.**

It is apparent that part of the space between the end plates 363 and 364 is occupied by the module 396; the remainder of the space is occupied by wheels 381 and associated detents 410, and mounting and spacing members 388 and end plates 395 and 409. The lower end of the frame 361 is received in nothces **388*a* of members 388, 395 and 409.**

Each wheel 381 is provided with a detent 410 which includes a pair of springs 411 and a plunger 412. The springs 411 urge the plungers 412 into detenting relationship with respective wheels 381. The lower ends of the plungers 412 are concave as indicated at 412' so that when the associated wheel 381 rotates a corner of the wheel 318 will ride on concave surface 412' and the plunger 412 will travel a shorter distance and the associated spring 412 will be compressed to a lesser degree than if the lower surface were flat as is the lower surface 402' of the plunger 402. The ends of the plungers 412 have short flats 412'' to provide two-point detenting contact with associated wheels 381. A retainer plate 413 is secured to the section 363 of the support assembly frame 361 by screws 413' received in respective threaded holes 414. The plate has a top portion 415 with holes 416 through which the screws 413' extend, a flange portion 417 joined to the top portion 415, and a retainer portion 418 joined to the top portion 415 which extends into notches **388*b* of the members 388, 395 and 409.**

The illustrated arrangement shown in FIGS. 20 through 26, shows the support assembly 360 as composed in part of a module 396 having small support wheels 382, and in remainder of large wheels 381 and detents 410, members 409, 388 and 395. As viewed in FIGS. 21 and 22, the module 396 comprises the left hand portion of the assembly 360 and the wheels 381, the members 388, 395 and 409 comprise the remainder of the assembly 360. If desired, the module 396 can comprise the right hand portion of the assembly, or the central portion. The module frame can be longer or shorter than shown. The assembly 360 can comprise two or more modules, such as the module 396 and the remaining space or spaces can be comprised of large wheels 381, members 409, 388 and 395 and detents 410 and a shaft of appropriate length like the shaft 387. The assembly 360 can also be comprised of two or more modules, like the module 396, mounted end-to-end with one or more modules having large wheels like the wheels 381 with one or more modules having small wheels like the wheels 382.

The support assembly 359 can be constructed using the same components as the support assembly 360 in any desired arrangement.

With reference to FIG. 2, the record members 37 are shown to be guided by a guide 108''. The record members 37 are shown to comprise tickets arranged in a web and partially severed by lines of perforation 37'. Control elements in the form of notches 37'' are disposed in the web in transverse alignment with the perforations 37'. A switch 436 is mounted by the frame 31 in the path of the notches 37''. The record members 37 can as well comprise pressure sensitive labels carried on a web of supporting material (not shown). To make a multipart ticket such as a two-part ticket (or label) the web would be severed at every other line of perforation 37'.

Figure 27:
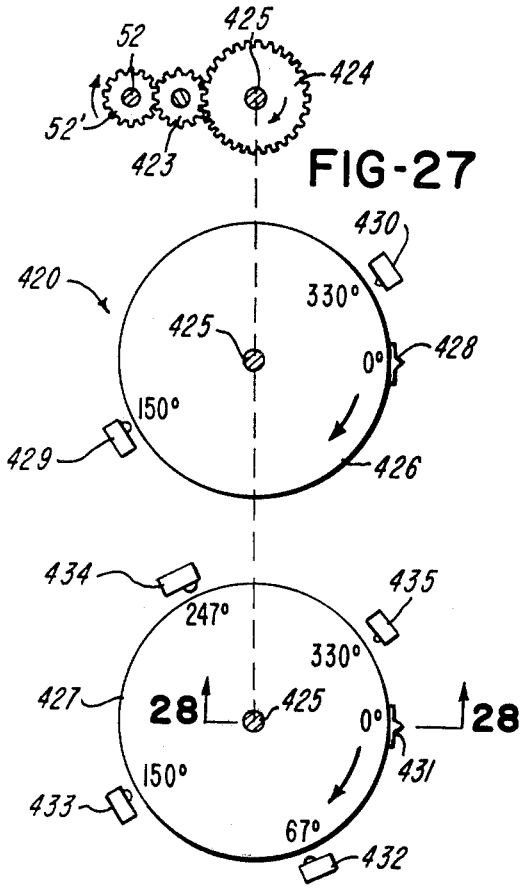
FIG. 27 is a diagrammatic view showing the manner in which the functions of the printing apparatus are timed.

Referring to FIGS. 27 through 30, there is shown diagrammatically a control system 420. The clutch 51 can be operated by any suitable means such as the controls fully disclosed in U.S. Pat. No. 3,228,601. The clutch is diagrammatically illustrated as being mechanically connected by controls 422 disclosed in U.S. Pat. No. 3,228,601 to a control panel 421 having a start button 421'. The controls 422 can be set to operate the printing apparatus 30 for the desired number of machine cycles. The desired number of cycles is initiated by depressing start button 421'. At the end of the cycles corresponding to the number to which the counter (38 in U.S. Pat. No. 3,228,601) is set, the clutch 51 is disengaged. As indicated in FIGS. 1 and 27, a gear 52' is secured to the drive shaft 52. The gear 52' drives an idler gear 423 which in turn drives a gear 424. The gear ratio between the gears 52' and 424 is 2 to 1 so that the gear 424 rotates one-half as fast as the gear 52'. The gear 424 is secured to a shaft 425 to which cams 426 and 427 are secured. The cam 426 is circular except for a pointed lobe 428 which momentarily closes a switch 429 during one machine cycle and which momentarily closes a switch 430 during the next machine cycle. With reference to FIG. 3, it will be recalled that at the initial or rest position of the machine and also at the initiation of a machine cycle the shaft 52 is in an initial position such that the crank pin 56 is in the position shown by phantom lines 56' in FIG. 3. This position corresponds to the 0° position of the cams 426 and 427. The switch 429 is at the 150° position of the cam 426 which, because of the speed reduction effected between 52' and 424, corresponds to the 300° position of the crank pin 56. The switch 430 is at the 330° position of the cam 426 which corresponds to the 300° postion of the crank pin 56. The cam 427 is circular and mounts an adjustable pointed cam lobe 431 best shown in FIG. 28. Switches 432, 433, 434 and 435 are in the path of the cam lobe 431 when the cam lobe 431 is in the solid line position shown in FIG. 28. The switch 432 is at the 67° position of the cam 427 which corresponds to the 134° position of the crank pin 56. The switch 433 is at the 150° position of the cam 427 which corresponds to the 300° position of the crank pin 56. The switch 434 is at the 247° position of the cam 427 which corresponds to the 134° position of the crank pin 56. The switch 435 is at the 330° position of the cam 427 which corresponds to the 300° position of the crank pin 56. When screw 427' is loosened and the lobe 431 is shifted to the phantom line position indicated by phantom lines 431' and the screw 427' is thereupon tightened, the switches 432 and 433 are out of the path of the lobe 431 and hence the switch 432 will not be closed and the switch 433 will not be opened upon rotation of the cam 427. If the lobe 431 is completely removed upon unscrewing the screw 427', none of the switches 432, 433, 434 or 435 will be in the path of the lobe 431 and hence none will be operated during rotation of the cam 427.

Figure 30:
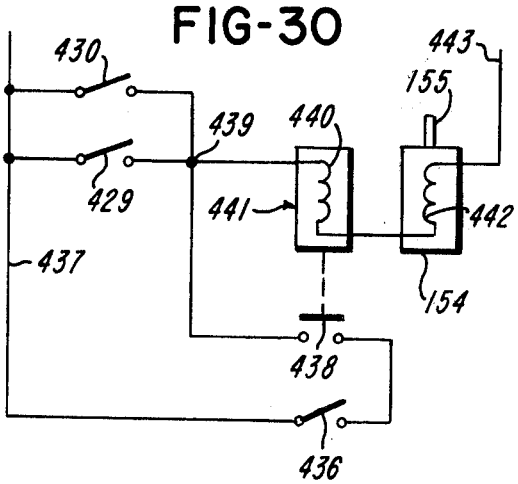
FIG. 30 is a schematic circuit diagram for the record feed mechanism.

With reference to FIG. 30, a lead 437 is directly connected to the switches 429. 430, and 436. A switch 438 connects the switch 436 and a node 439. The switches 429 and 430 and one side of winding 440 of a relay 441 are also connected to the node 439. The other side of the winding 440 is connected to one side of a winding 442 of the solenoid 154. The other side of the winding 442 is connected to a lead 443.

Figure 29:
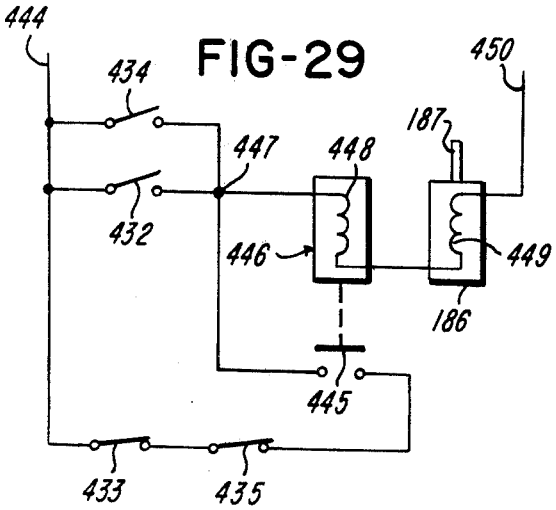
FIG. 29 is a schematic circuit diagram showing a manner in which the record severing function can be accomplished.

With reference to FIG. 29, a lead 444 is connected directly to the switches 432, 433 and 434. A switch 435 and a switch 445 which forms a part of a relay 446 are connected in series with the switch 433 to a node 447. The switches 432 and 433 and one side of a winding 448 of the relay 446 are also connected to the node 447. The other side of the winding 448 is connected to one side of a winding 449 of the solenoid 186. The other side of the winding 449 is connected to a lead 450.

Figure 8:
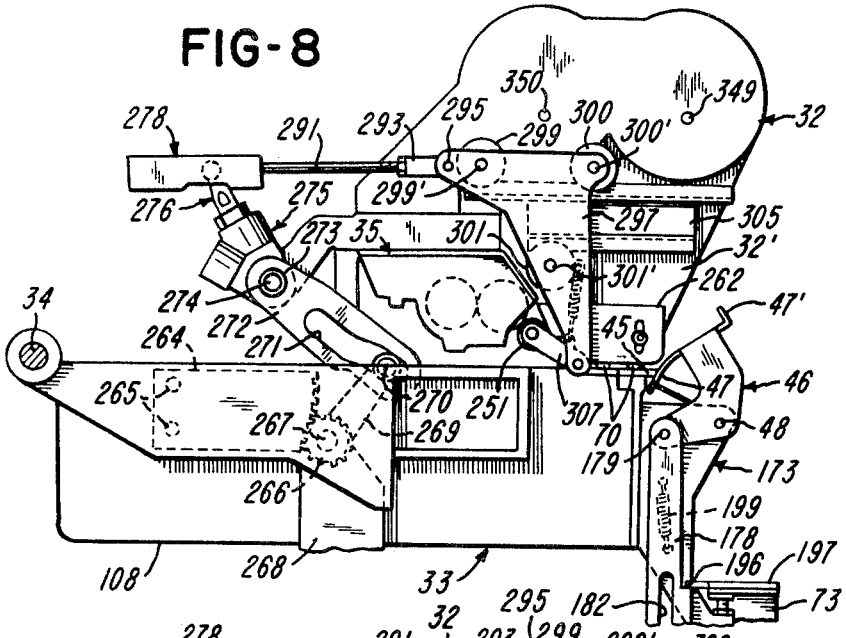
FIG. 8 is a partly diagrammatic side elevational view showing the platen assembly in printing cooperation with the print head assembly, showing the inking mechanism in a position in which the ink roll is in engagement with the ink transfer roll, and showing the severing mechanism as having severed a record member from the web.

Assuming that the apparatus 30 is set to print six one-part tickets 37 the start button 421' (FIG. 1) of the controls 422 is depressed which effects engagement of the clutch 51. The shaft 52 starts to rotate, causing the gears 52', 423 and 424 and cams 426 and 427 to rotate. As the cam 427 rotates through 67°, the switch 432 is momentariluy closed to complete a circuit from the line 444, through the switch 432, through the winding 448 of relay 446, through the winding 449 of the solenoid 186 to the line 450, thereby completing a circuit. Energization of the relay winding 448 causes closure of the switch 445, thereby completing a holding circuit from the line 444, through switches 433, 435 and 445, through the windings 448 and 449 to the line 450. Energization of the solenoid 186 pivots the links 178 and 180 counterclockwise from the position shown in FIG. 9 into abutment with end 198 of the plate 197. As the drive shaft 52 continues to rotate the platen assembly 33 is driven counterclockwise, and links 178 and 180 move generally upwardly together with the platen assembly 33 until respective stop shoulders 184 and 185 contact the stop face 196 of the plate 197. The trailing edge of the record member 37 which was previously printed is in alignment with the knife 45; as the platen assembly 33 moves counterclockwise to the fullest extend as shown in FIG. 8, the movable knife 47 has moved from the position shown in FIG. 9 to the position shown in FIG. 8, thereby severing the previously printed ticket. When the platen assembly 33 is in the position shown in FIG. 8, the drive shaft 52 has rotated through 275° and the cams 426 and 427 have rotated through 137.5°. The cam lobe 431 opens the switch 433 when the cam 427 has rotates through 150°, thereby deenergizing the solenoid 186. The spring 188 immediately causes the links 178 and 180 to return to their clockwise positions (FIG. 9). When the drive shaft 52 has rotated through 300°, the platen 44 has moved downwardly sufficiently to permit the web of record members 37 to be advanced; at this instant in the machine cycle the cam 426 has rotated through 150° and the switch 429 is momentarily closed, completing a circuit from the lead 437, through the switch 429, through windings 440 and 442 to the lead 443. Energization of the relay winding 440 causes closure of the switch 438, and energization of the solenoid 154 causes the control member 145 to pivot to the phantom line position shown in FIG. 18 out of contact with the O-ring 126, thereby causing the clutch 120 to engage to drive the web of record members 37. As soon as the switch 436 no longer senses a notch 37'', the switch 436 closes. Now that switches 436 and 438 are both closed, a holding circuit from the lead 437 through switches 436 and 438, and through the windings 440 and 442 is completed. As long as the solenoid 154 is energized the control member 145 is held away from the O-ring 126 and the clutch 120 is engaged to cause the advance of the web. As soon as the switch 436 senses the next notch 37'', the switch 436 opens to deenergize the solenoid 154, so that the spring 156 pivots the control member 145 to the solid line position shown in FIG. 18 to effect disengagement of the clutch 120. As the clutch 51 remains engaged, the drive shaft 52 continues to rotate through the 360° (or 0°)position and the cams 426 and 427 continue to rotate through their 180° positions. When the drive shaft 52 has rotated through 360° the feeding of the web has already been completed. When the cam 427 has rotated through 247° the switch 434 closes momentarily to energize the windings 448 and 449 and to close the switch 445 to establish the previously described circuit for the purpose previously described. When the cam 426 and 427 have rotated through 330° the lobe 431 of the cam 427 opens the switch 435 to deenergize the solenoid 186, and the lobe 428 of the cam 426 closes the switch 430 to energize the windings 440 and 442 to consequently close switches 436 and 438 as previously described to maintain energization of the solenoid 154 to advance the web until the switch 436 again senses a notch 37'' in the web. The drive shaft 52 and the cams 426 and 427 and the machine continues to cut, print and feed until the counter of the controls 422 has reached the sixth count at which time the clutch 51 is disengaged.

Figure 28:
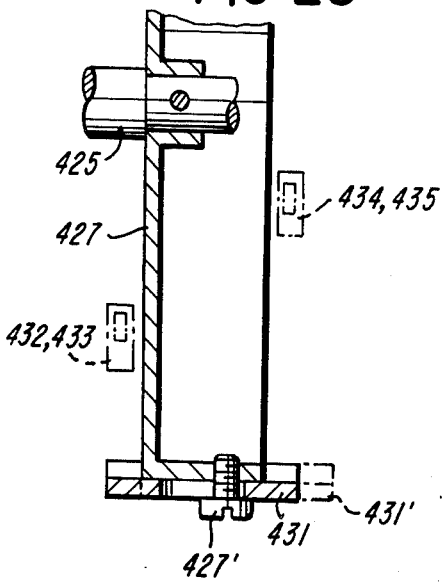
FIG. 28 is a sectional view taken generally along line 28—28 of FIG. 27.

If it is desired to provide two-part tickets, the cam lobe 431 is shifted to the phantom line position shown by lines 431' in FIG. 28, in which event the cam lobe 431 never closes switch 432 or opens switch 433. Accordingly, the knife 47 is only operated at every other rotation of the drive shaft and is only under the control of switches 434 and 435.

If it is not desired to sever automatically any of the tickets 37 from the web, the cam lobe 431 is removed, in which event neither the switch 432 nor the switch 434 is ever closed and neither the switch 433 nor the switch 435 is ever opened.

Figure 31:
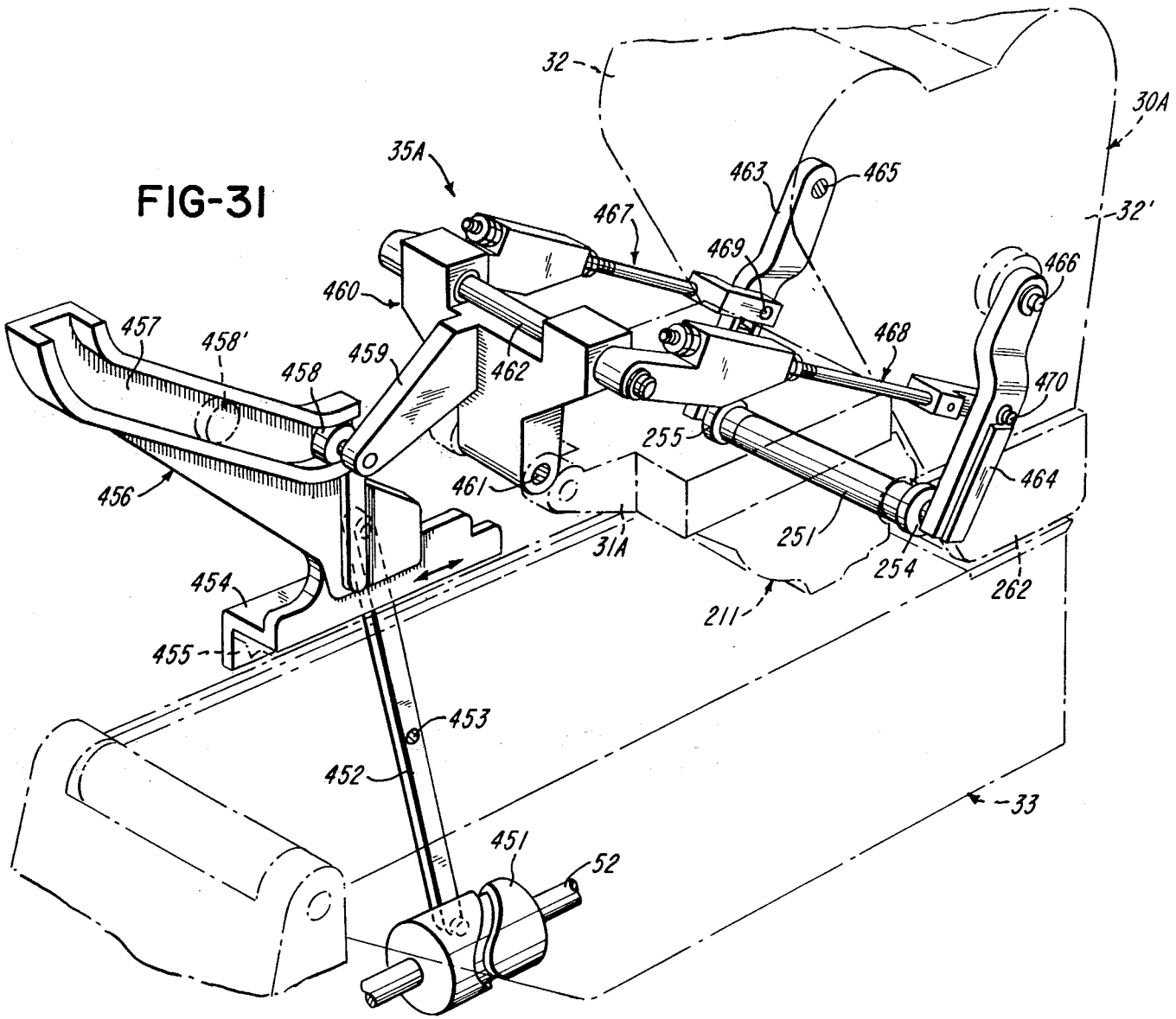
FIG. 31 is a perspective view of an alternate form of drive and mounting mechanism for the ink roll.
Figure 34:
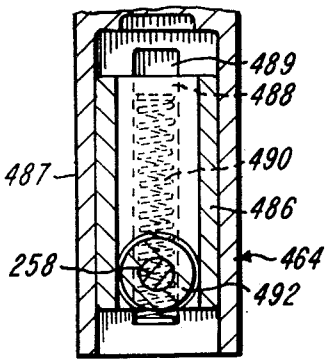
FIG. 34 is a sectional view taken along line 34—34 of FIG. 33.
Figure 35:
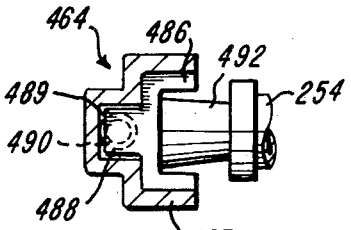
FIG. 35 is a sectional view taken along line 35—35 of FIG. 33.

Another embodiment of an inking mechanism 35A is illustrated in FIGS. 31 through 35, in conjunction with the printing apparatus 30A and the fountain 211 illustrated by phantom lines in FIG. 31. The printing apparatus 30A differs from the apparatus 30 in that part of the drive mechanism for the ink roll 251 is of the same construction disclosed in U.S. Pat. No. 3,180,254; in that patent a barrel cam 160 drives an arm 166 which in turn drives a feed finger carriage 167, and that mechanism which is shown in detail in that patent and which is shown diagrammatically in FIG. 31 of the drawings of this application provides a part of the ink roll driving mechanism of the inker or inking mechanism 35A. More specifically, a barrel cam 451 (160 in the patent) secured to the shaft 52 (149 in the patent) rocks or pivots an arm 452 (166 in the patent) about a pivot 453 (179 in the patent) during one complete revolution to drive a carriage 454 (167 in the patent). The carriage 454 is mounted by a guide or way 455 secured to the platen assembly 33 (20 in the patent). The record feed mechanism is the same in the printing apparatus 30A as in the apparatus 30 and consequently the carriage 454 is not used to feed the record as is true in the patent.

A cam track 456 having a cam groove 457 is secured to the carriage 454. A roller 458 captive in the cam groove 457 is carried by an arm 459 of a bell crank 460. The bell crank 460 is pivotally mounted to the frame 31 of the apparatus 30A by a pivot pin 461. The bell crank mounts a pivot pin 462.

A pair of identical arms 463 and 464 are pivotally mounted by pivot pins 465 and 466 to end plates 32' of print head assembly 32 of the apparatus 30A, The arms 463 and 464 rotatably mount the ink roll 251. Spaced apart identical connnecting rods or links 467 and 468 are connected at their one ends respectively to the arms 463 and 464 by pivot pins 469 and 470 and at their other ends to the pivot pin 462.

Figures 32, 33:
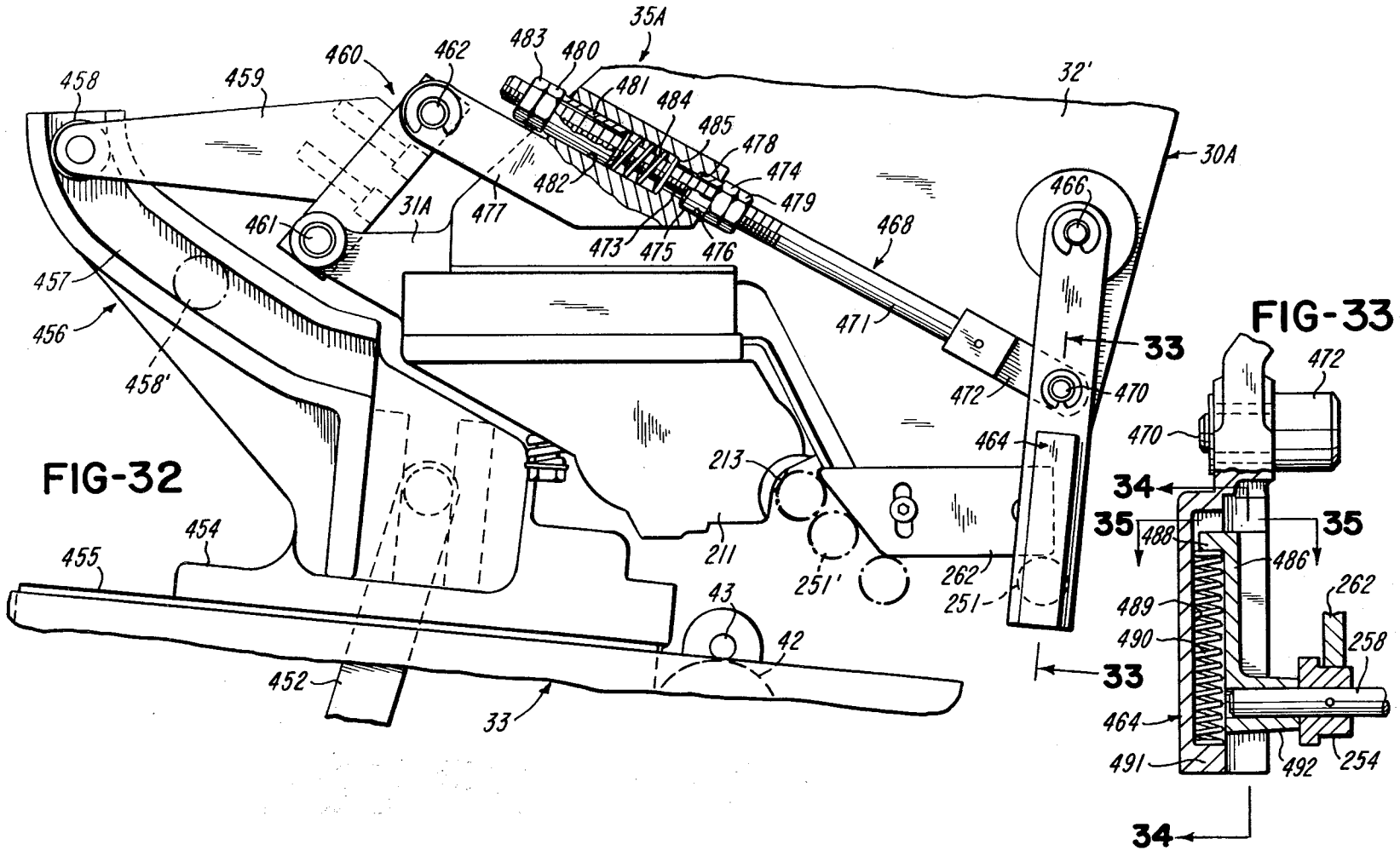
FIG. 32 is a side elevational view of the mechanism shown in FIG. 31.
FIG. 33 is a sectional view taken along line 33—33 of FIG. 32.

With reference to FIG. 32, one of the connecting rods 467 and 468, namely the connecting rod 468, is shown in section. The connecting rod 468 includes a rod 471 suitably connected by a connector 472 to the pivot pin 470. The rod 471 has a threaded section 473 which threadably receives nuts 474 and 480. The nut 474 has an annular tubular section 475 received about threaded section 473 in an open-ended bore 476 in a connector 477. The section 475 abuts a shoulder 478 at the end of the bore 476. A lock nut 479 can be tightened against the nut 475. The nut 480 has an annular tubular section 481 received about threaded section 473 slidably received in a bore 482 in the connector 477. A lock nut 483 can be tightened against the nut 480. A compression spring 484 is received in the bore 482 about the threaded section 473 between a shoulder 485 and one end of the tubular section 481. By adjusting the nuts 474 and 480 relatively toward or away from each other the path of travel of the ink roll 251 can be adjusted and the spring 484 can be compressed the desired amount. When the ink roll 251 is in the position shown in FIG. 32, the roller 458 is near the end of the cam groove 457 and with the ink roll 251 having inked the printing members.

The ink roll 251 which includes a shaft 258 and carries the wheels 254 and 255 (FIG. 15) is rotatably mounted in identical arms 463 and 464. A fragment of the arm 464 is shown in detail in FIGS. 33, 34 and 35. A slide 486 is slidably mounted in a channel-shaped section 487 of the arm 465. The slide 486 has a tab 488 which extends into an adjoining groove 489. A compression spring 490 is disposed in the groove 489 in abutment with the tab 488 and with a shoulder 491 at the end of the groove 489 at the lower end of the arm 464 opposite from the pin 466. The slide 486 has an integral tubular bearing 492 which received the end of the shaft 258. As the arms 463 and 464 move between the extreme positions shown in FIGS. 31 and 32, rollers 254 and 255 follow cams 262 and 263 and the respective springs 490 compress and extend.

Referring again to FIGS. 31 and 32, the roller 458 is initially in the position indicated at 458′ by phantom lines, the ink roll 251 being in the position indicated by phantom lines 251′. As the barrel cam 451 starts rotating the platen assembly 33 pivots clockwise (FIGS. 31 and 32) and the arm 452 pivots clockwise so that the roller 458 moves near the end of the cam groove 457 as shown by solid lines in FIG. 32, causing the ink roll 251 to be driven into ink-transferring relationship with the printing members. Continued rotation of the barrel cam 451 causes the cam 456 to be driven to the position shown in FIG. 31 in which the ink roll 251 is in ink receiving contact with the ink transferring roll 213. Continued rotation of the barrel cam 451 returns the roller 458 to the initial position shown by phantom lines 458′. The roll 251 is now out of the path of the platen assembly 33 as indicated by phantom lines 251′.

Other embodiments and modifications of this invention will suggest themselves to those skilled in the art, and all such of these as come within the spirit of this invention are included within its scope as best defined by the appended claims.

I claim:

1. A print head, comprising: a support assembly including a support frame, a first set of wheels rotatably mounted by the support frame, each wheel of the first set having a plurality of sides which are relatively long in its rotational plane, a support assembly module mounted by the support frame, the support assembly module including a module frame, a second set of wheels rotatably mounted by the module frame, each wheel of the second set having a plurality of sides which are relatively short in its rotational plane, a first set of printing bands engaged with and movable relative to the respective wheels of the first set, each printing band of the first set having a plurality of printing blocks with a printing block in supported contact with a side of a wheel of the first set, and a second set of printing bands engaged with and movable relative to the respective wheels of the second set, the module frame being mounted relative to the support frame so that the first and second sets of wheels are disposed in a row for enabling the printing bands to print a line of data, each printing band of the second set having a plurality of printing blocks with a printing block being in supported contact with a side of a wheel of the second set, the axis of rotation of the first set of wheels being parallel to the axis of rotation of the second set of wheels, the printing blocks of the first and second printing band which are in supported contact with the respective first and second wheels being disposed in a common plane.

2. A print head as defined in claim 1, wherein the support assembly module further includes a separate detent for each wheel of the first set.

3. A print head as defined in claim 1, wherein the first and second sets of wheels are square, the mounting means comprising a first shaft for mounting the first set of wheels for independent rotation and a second shaft for mounting the second set of wheels for independent rotation, the first and second shafts being parallel.

4. A print head, comprising: a support assembly including a support frame, a first set of wheels rotatably mounted by the support frame and filling the support frame to less than its full capacity, each wheel of the first set having a plurality of sides which are of a certain length in its rotational plane, a support assembly module including a module frame and a second set of rotatably mounted wheels filling at least part of the remaining capacity of the support frame, each wheel of the second set having a plurality of sides which are of a different length in its rotational plane than the certain length of the sides of the wheels of the first set, the module frame being mounted relative to the support frame so that the first and second sets of wheels are disposed in a row for enabling the printing bands to print a line of data, a printing band engaged with and movable relative to each of the wheels, and means connecting the support frame and the module frame.

5. A print head as defined in claim 4, wherein each printing band engaged with a side of the respective wheel of the first set has relatively long printing blocks, and each printing band engaged with a side of the respective wheel of the second set has relatively short printing blocks.

6. A print head, comprising: a support assembly including a support frame, a first set of multisided wheels mounted by the support frame, a support assembly module mounted by the support frame, the support assembly module including a module frame, a second set of multisided wheels mounted by the module frame, the second set of wheels differing in radial dimension from the first set of wheels, a first set of printing bands engaged with and movable relative to the respective wheels of the first set, each printing band of the first set having a plurality of printing blocks with a printing block in supported contact with one wheel of the first set, and a second set of printing bands engaged with and movable relative to the respective wheels of the second set, each printing band of the second set having a plurality of printing blocks with a printing block being in supported contact with one wheel of the second set, the printing blocks of the first and second printing bands which are in supported contact with the respective first and second wheels being disposed in a common plane and being aligned to print a line of data.

7. A print head as defined in claim 6, wherein the support assembly module further includes a separate detent for each wheel of the first set, and means for connecting the support assembly module to the support frame.

8. A print head as defined in claim 6, wherein the first and second sets of wheels are square, a first shaft for mounting the first set of wheels for independent rotation and a second shaft for mounting the second set of wheels for independent rotation, the first and second shafts being parallel.

9. A print head, comprising: a support assembly including a support frame a first set of multisided wheels mounted by the support frame and filling the support frame to less than its full capacity, a support assembly module including a module frame and a second set of multisided wheels filling at least part of the remaining capacity of the support frame, the first and second sets of wheels being disposed in the same row, the first set of wheels being of a different radial dimension than the second set of wheels, a printing band engageable with and movable relative to each of the wheels, and means connecting the support frame and the module frame.

10. A print head as defined in claim 9, wherein the first set of wheels are larger in radial dimension than the second set of wheels, wherein each printing band engaged with a wheel of the first set has relatively long printing blocks, and each printing band engaged with a wheel of the second set has relatively short printing blocks.

* * * * *

UNITED STATES PATENT AND TRADEMARK OFFICE

CERTIFICATE OF CORRECTION

PATENT NO. : 4,023,485

DATED : May 17, 1977

INVENTOR(S) : Raymond L. Kirby, Jr.

It is certified that error appears in the above-identified patent and that said Letters Patent are hereby corrected as shown below:

Column 1, line 57, "Fig. 11" should start a new paragraph. Column 2, line 10, "Fig. 21" should start a new paragraph; line 34, "Fig. 32" should start a new paragraph. Column 3, line 44, "heat" should be --head--. Column 4, line 32, "top" should be --stop--; line 68, "drive" should be --driven--. Column 5, line 5, "141" should be --142--; line 30, "30" should be --130--; line 48, "120" should be --130--; line 59, "123" should be --113--. Column 6, line 16, "15" should be --155--. Column 7, line 6, "With" should start a new paragraph; line 38, after "180" --is-- has been omitted. Column 8, line 67, after "frame" --221-- has been omitted. Column 9, line 9, "21" should be --211--; line 52, "51" should be --251--. Column 10, line 29, "60" should be --260--; line 47, "joint" should be --joints--; line 48, after "279" --. The ball joints 276 and 277 and the sockets 278 and 279-- has been omitted. Column 11, line 30, "216" should be --316--; line 35, "329" should be --320--; line 59, after "rotate" a comma --,-- has been omitted; line 65, "21" should be --211--. Column 13, line 23, "23" should be --22--; line 26, the comma "," should be a period --.--. Column 14, line 15, after "corresponding" --character--

UNITED STATES PATENT AND TRADEMARK OFFICE

CERTIFICATE OF CORRECTION

PATENT NO. : 4,023,485

DATED : May 17, 1977

INVENTOR(S) : Raymond L. Kirby, Jr.

It is certified that error appears in the above-identified patent and that said Letters Patent are hereby corrected as shown below:

has been omitted; line 22, "318" should be --381--. Column 16, line 44, "429." should be --429,--; line 67 "momentarily" has been misspelled. Column 17, line 25, "rotates" should be --rotated--. Column 18, line 51, the comma "," should be a period --.--. Column 19, line 18, "465" should be --464--. Column 20, line 9, claim 1, "band" should be --bands--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*